US008942397B2

(12) United States Patent
Anderson

(10) Patent No.: US 8,942,397 B2
(45) Date of Patent: Jan. 27, 2015

(54) METHOD AND APPARATUS FOR ADDING AUDIBLE NOISE WITH TIME VARYING VOLUME TO AUDIO DEVICES

(71) Applicant: Dean Robert Gary Anderson, Orem, UT (US)

(72) Inventor: Dean Robert Gary Anderson, Orem, UT (US)

(73) Assignee: Dean Robert Gary Anderson, Orem, UT (US), as Trustee of the D/L Anderson Family Trust ( * ) Notice: Subject to any disclaimer, the term of this patent is extended or adjusted under 35 U.S.C. 154(b) by 0 days.

(21) Appl. No.: 13/677,630

(22) Filed: Nov. 15, 2012

(65) Prior Publication Data

US 2013/0121517 A1 May 16, 2013

Related U.S. Application Data

(60) Provisional application No. 61/560,629, filed on Nov. 16, 2011.

(51) Int. Cl.
*H04R 25/00* (2006.01)

(52) U.S. Cl.
CPC ..... *H04R 25/50* (2013.01); *H04R 25/43* (2013.01); *H04R 2225/43* (2013.01)
USPC ..... 381/316; 381/320

(58) Field of Classification Search
CPC ..... H04R 25/353; H04R 25/35
USPC ..... 381/316, 320
See application file for complete search history.

(56) References Cited

U.S. PATENT DOCUMENTS

| | | | | |
|---|---|---|---|---|
| 3,385,937 | A * | 5/1968 | Lafon | 381/316 |
| 5,197,332 | A | 3/1993 | Shennib | |
| 5,325,436 | A | 6/1994 | Soli et al. | |
| 5,396,560 | A | 3/1995 | Arcos et al. | |
| 5,717,767 | A | 2/1998 | Inanaga et al. | |
| 5,825,894 | A | 10/1998 | Shennib | |
| 5,868,682 | A | 2/1999 | Combs et al. | |
| 5,870,481 | A | 2/1999 | Dymond et al. | |
| 5,878,146 | A | 3/1999 | Andersen | |
| 5,923,764 | A | 7/1999 | Shennib | |

(Continued)

FOREIGN PATENT DOCUMENTS

| | | | |
|---|---|---|---|
| EP | 1933590 | A1 | 6/2008 |
| GB | 2394632 | A | 4/2004 |
| WO | 2008141672 | A1 | 11/2008 |

OTHER PUBLICATIONS

Sakamoto et al.; "Frequency compression hearing aid for severe-to-profound hearing impairments"; Oct. 2000; Auris Nasus Larynx; vol. 27, Issue 4; pp. 327-334.*

(Continued)

*Primary Examiner* — Curtis Kuntz
*Assistant Examiner* — Ryan Robinson
(74) *Attorney, Agent, or Firm* — Morriss O'Bryant Compagni, PC

(57) ABSTRACT

A method and apparatus for adding audible noise with time varying volume to audio devices are disclosed which makes the time varying volume envelope of the added audible noise proportional to the time varying volume envelope of sound for frequencies where an individual has a restricted range of perception. The method and apparatus are used to improve the audibility, speech intelligibility, and word recognition characteristics in audio devices.

64 Claims, 13 Drawing Sheets

(56) References Cited

U.S. PATENT DOCUMENTS

| | | | | |
|---|---|---|---|---|
| 6,167,138 | A | 12/2000 | Shennib | |
| 6,201,875 | B1 | 3/2001 | Davis et al. | |
| 6,236,731 | B1 | 5/2001 | Brennan et al. | |
| 6,389,142 | B1 | 5/2002 | Hagen et al. | |
| 6,567,524 | B1 | 5/2003 | Svean et al. | |
| 6,574,342 | B1 | 6/2003 | Davis et al. | |
| 6,577,740 | B1 | 6/2003 | Bordewijk | |
| 6,674,862 | B1 | 1/2004 | Magilen | |
| 6,731,769 | B1 | 5/2004 | Lenhardt | |
| 6,885,752 | B1 | 4/2005 | Chabries et al. | |
| 6,912,289 | B2 | 6/2005 | Vonlanthen et al. | |
| 7,058,188 | B1 * | 6/2006 | Allred | 381/107 |
| 7,206,423 | B1 | 4/2007 | Feng et al. | |
| 7,418,379 | B2 | 8/2008 | Vierthaler | |
| 7,502,483 | B2 * | 3/2009 | Rikimaru | 381/320 |
| 7,903,833 | B2 | 3/2011 | Goldberg et al. | |
| 8,094,834 | B1 | 1/2012 | Brungart | |
| 2003/0142746 | A1 | 7/2003 | Tanaka et al. | |
| 2004/0006283 | A1 | 1/2004 | Harrison et al. | |
| 2004/0076301 | A1 | 4/2004 | Algazi et al. | |
| 2006/0008102 | A1 | 1/2006 | Westergaard | |
| 2006/0182294 | A1 | 8/2006 | Grasbon et al. | |
| 2006/0204013 | A1 | 9/2006 | Hannibal et al. | |
| 2006/0210090 | A1 | 9/2006 | Shennib | |
| 2007/0127753 | A1 | 6/2007 | Feng | |
| 2007/0223720 | A1 | 9/2007 | Goldberg | |
| 2009/0116657 | A1 | 5/2009 | Edwards et al. | |
| 2009/0208024 | A1 * | 8/2009 | Farver et al. | 381/56 |
| 2010/0310101 | A1 | 12/2010 | Anderson | |
| 2011/0019846 | A1 | 1/2011 | Anderson | |
| 2011/0075853 | A1 | 3/2011 | Anderson | |
| 2011/0150256 | A1 * | 6/2011 | Baechler et al. | 381/316 |
| 2011/0170711 | A1 | 7/2011 | Rettelbach | |

OTHER PUBLICATIONS

Sakamoto et al.; "Frequency compression hearing aid for severe-to-profound hearing impairments"; Oct 2000, Auris Nasus Larynx; vol. 27, Issue 4; pp. 327-334.

Alger, Alexandra. "A Chip in the Ear." FORBES. Nov. 2, 1998.

Gelfand, Stanley A. Essentials of Audiology, Third Edition, Mar. 2009, Thieme, p. 250-253.

Edgar Villchur, "Signal Processing to Improve Speech Intelligibility in Perceptive Deafness", the Journal of the Acoustical Society of America, vol. 53, No. 6, 1973, pp. 1646-1657 (Abstract) (http://asadLorg/jasa/resource/1/jasman/v53/i6/p1646_s1?isAuthorized=no).

Ghent, Robert M., Jr. et al. "Interactive Binaurally Balanced Fittings for Improved Audibility, Reduced Costs, and Fewer Return Visits" the Hearing Review, Nov. 3, 2011.

Kraus, Eric M., MD, et al., "Envoy Esteem Totally Implantable Hearing System : Phase 2 Trial, 1-Year Hearing Results," Otolaryngology—Head and Neck Surgery, American Academy of Otolaryngology, Mar. 31, 2011.

* cited by examiner

METHOD AND APPARATUS FOR ADDING AUDIBLE NOISE WITH TIME VARYING VOLUME TO AUDIO DEVICES

CROSS-REFERENCE TO RELATED APPLICATION

The present application claims priority to U.S. Provisional Patent Application Ser. No. 61/560,629 filed on Nov. 16, 2011, by Dean Robert Gary Anderson, the entirety of which is incorporated by this reference.

BACKGROUND OF THE INVENTION

1. Field of the Invention

The present invention relates generally to audio devices, and more particularly, to systems, devices and methods relating to hearing aids, personal sound amplification products, devices with limited audio bandwidth, televisions, radios, cell phones, computers, laptops, tablets, personal media players, and recording devices for improving audio clarity for those with moderate, severe and/or profound hearing loss.

2. Description of Related Art

Improving audibility, speech intelligibility, and word recognition are some of the primary purposes of hearing aid devices and personal sound amplification products. Word recognition testing at various presentation levels and their corresponding performance intensity functions are a generally accepted means of quantitatively measuring such improvement. Recent advancements in precision hearing measurement and fitting using data derived from binaural balance measurements (see United States Patent Application Pending Publication Numbers: US-2010-00310101-A1; US-201100019846-A1; and US-2011-0075853-A1, the entirety of each of which are incorporated by this reference) demonstrate that progress is being made to improve aided audibility.

Complete restoration of audibility for the hearing impaired, however, is not yet equal to the 20/20 vision correction that eyeglasses can provide for individuals with impaired vision. Much of this is due to the fact that the hearing impaired individuals have permanent nerve damage for some frequencies necessary for normal speech audibility. Precision hearing measurement and precision hearing aid fitting alone cannot overcome this sort of nerve damage.

To the individual with auditory nerve damage, speech often sounds muddled. Individuals complain that speakers need to articulate more or enunciate better. For these individuals, speech simply does not sound clear. Moreover, merely turning up the aided volume does not result in improved audibility to the hearing impaired.

The need to make speech more "clear" has focused much attention on noise reduction in aided products in an effort to improve audibility. For example, directional microphones work to diminish competing off-axis sounds. Digital Signal Processors ("DSPs") in most hearing aids today include specific noise reduction algorithms in an effort to reduce extraneous noise. Difficulties exist however in separating extraneous noise from important speech information especially when the noise is speech from competing speakers.

Some hearing aid manufactures have attempted frequency-shifting techniques to overcome frequencies where an individual has permanent nerve damage or "dead bands". These approaches are complex to implement and consume many valuable digital signal processor instruction cycles during each sampling period.

Adding audible noise to drive an audio signal above audiometric thresholds has been proposed by others (see United States Patent Application Pending Publication Number: US-2010-0316240-A1, the entirety of which is incorporated by this reference). This approach, however, does not replace or recreate the important speech information for frequencies where the individual has "dead bands" nor does the approach move speech information contained in the individual's "dead bands" to audible frequencies.

Sharp sound is a common hearing aid consumer complaint. Some hearing aid users complain that common sounds like a door closing, keys dropping, or kitchen noise can be painful. Amplification for frequencies where the user has severe hearing loss is difficult as sound can quickly change from being barely audible to being uncomfortably loud with only a small change in actual volume. Sharp or painful sound is usually the result of too much amplification especially for frequencies where the user deals with severe hearing loss. In addition, the United States Food and Drug Administration (FDA) has warned hearing aid device consumers: "too much amplification may cause additional hearing loss."

Hearing aid devices and personal sound amplification products change the local sound environment for their users. These devices and products are worn by some for the greater part of each day. The United States National Institute for Occupational Safety and Health (NIOSH) has established recommendations for time dependent noise exposure criteria in DHHS (NIOSH) Publication No. 98-126 (the entirety of which is herein incorporated by this reference). Other government agencies worldwide and other generally recognized standard authorities have established similar time dependent noise exposure criteria. Currently, no hearing aid devices or personal sound amplification products measure and report noise dosage to the user and enable the user to make an informed decision as to the amount of daily usage.

Another common hearing aid consumer complaint is high frequency squealing. Squealing occurs when the audio loop gain between the receiver and microphone equals or exceeds unity. In current best practices, significant high frequency amplification is often prescribed for hearing aid users. To cancel audio feedback, some hearing aids inject audio signals that are in opposite phase to detected oscillations. Still, ear molds or other physical sound barriers must be used in many cases to attenuate loop gain below unity. This leads to consumer occlusion complaints or complaints about the physical fit of the ear mold itself.

Finally, hearing aid fittings generally require accurate measurement of audiometric thresholds at specific frequencies. Fluctuating hearing loss over a period of days, weeks or months is common for juveniles and adults or individuals with Meniere's disease. Consequently, for individuals with fluctuating hearing loss, current hearing aid technologies require frequent readjustment by hearing healthcare professionals to maintain a modicum of satisfaction.

Thus, there exists a need in the art to provide a method, system and device for improving audibility, speech intelligibility and word recognition via hearing aid devices or other personal sound amplification products for those with moderate, severe and/or profound hearing loss.

SUMMARY OF THE INVENTION

Accordingly, the present invention provides methods and systems for adding audible noise with time varying volume to audio devices that overcome the problems associated with prior art audio devices, including hearing aids and the like, and techniques and methods for customizing such audio devices by making the time varying volume envelope of the added audible noise proportional to the time varying volume envelope of sound for frequencies where an individual has a restricted range of perception. The methods and systems are used to improve the audibility, speech intelligibility, and word recognition characteristics of sound produced by the audio devices.

In various representative aspects of the present invention, a filtered volume determiner measures the time varying volume envelope of sounds where the individual has restricted sound perception, a filtered noise generator is used to create sounds that are audible to the individual, a modulator is provided to modulate the output of the filtered noise generator so that it is proportional to the measured time varying volume envelope, and a mixer is provided to add the audible noise having the time varying volume envelope to the audio signal. The result is that the individual's discernibility, perceptibility and clarity of speech is significantly improved.

An audio system according to the present invention comprises a filtered volume determiner configured to receive a first signal. The filtered volume determiner is configured to generate a second signal corresponding to a volume envelope for a first range of selected frequencies of the first signal. A filtered noise generator is configured to generate a third signal corresponding to noise substantially within a second range of selected frequencies. A signal modulator is coupled to the filtered volume determiner and to the filtered noise generator. The signal modulator is configured to receive from the filtered volume determiner the second signal, and the signal modulator is configured to receive from the filtered noise generator the third signal. The signal modulator is configured to generate a fourth signal substantially similar to a product of a weighted second signal and a weighted third signal. A mixer is coupled to the signal modulator and is configured to receive from the signal modulator the fourth signal. The mixer is configured to receive a fifth signal substantially similar to the first signal to generate a sixth signal substantially similar to a sum of a weighted fourth signal and a weighted fifth signal.

In one embodiment of the audio system, the first range of selected frequencies is selected as a function of the user's hearing loss.

In another embodiment, the first range of selected frequencies comprises frequencies for which a user's audiometric thresholds exceed a threshold for profound hearing loss.

In yet another embodiment, the first range of selected frequencies comprises frequencies for which a user's audiometric thresholds exceed a threshold for severe hearing loss.

In still another embodiment, the first range of selected frequencies is determined by the user.

In yet another embodiment, the second range of selected frequencies is selected as a function of the user's hearing loss.

In another embodiment of the audio system, the second range of selected frequencies comprises frequencies for which a user's audiometric thresholds are less than a threshold for profound hearing loss.

In yet another embodiment, the second range of selected frequencies comprises frequencies for which a user's audiometric thresholds are less than a threshold for severe hearing loss.

In still another embodiment, the second range of selected frequencies is determined by the user.

In yet another embodiment, the filtered volume determiner comprises a filter coupled to a peak detector, and the filter is configured to receive the first signal and generate a tenth signal, and the peak detector is configured to receive the tenth signal and generate the second signal.

The filters of the audio system of the present invention may be a high-pass filter or a band-pass filter.

In still another embodiment, the peak detector receives the tenth signal, and the peak detector generates the second signal, which is an alpha-filtered absolute value of the tenth signal over a time period.

In another embodiment, the filtered noise generator comprises a noise generator coupled to a noise filter. The noise generator generates an eleventh signal and the noise filter is configured to receive the eleventh signal and generate the third signal.

In still another embodiment, the noise generator generates a signal comprised substantially of distributed audio frequencies.

In yet another embodiment, an output filter is coupled to receive the sixth signal and to generate a seventh signal substantially within a third range of selected frequencies. The third range of selected frequencies may be selected as a function of the user's hearing loss. In addition, the third range of selected frequencies may comprise frequencies for which a user's audiometric thresholds are less than a threshold for profound hearing loss or a threshold for severe hearing loss. The third range of selected frequencies may also be determined by the user.

In another embodiment, a splitter is configured to receive an eighth signal. The splitter generates the first signal and the fifth signal. Thus, the first signal, the fifth signal and the eighth signal are all substantially similar.

In yet another embodiment, an input filter is coupled to receive a ninth signal and generates the eighth signal substantially within a fourth range of selected frequencies. The fourth range of selected frequencies may be selected as a function of frequencies used for speech.

An audible or visual warning may be provided to the user of the system indicating that time dependent noise exposure criteria has equaled or exceeded a predetermined amount.

In still another embodiment, the first range of selected frequencies is dominated by consonant sound components. The second range of selected frequencies is selected as an intermediate frequency range between frequencies dominated by vowel-like sounds and consonant-like sounds. The third range of selected frequencies is limited to the voice frequency band.

The present invention also includes a method for adding a noise signal to an audio signal by receiving a first signal, selecting from the first signal, a volume information corresponding to sound intensities of a first range of frequencies, generating a noise signal, wherein the noise signal corresponds to noise substantially within a second range of selected frequencies, generating a modulated noise signal, wherein the modulated noise signal is substantially proportional to the product of the noise signal multiplied by the volume information, and generating a summation signal, wherein the summation signal is substantially proportional to the sum of a weighted modulated noise signal and a weighted first signal.

These and other features of the present invention are more fully described in the detailed description of the invention with reference to the drawings.

BRIEF DESCRIPTION OF THE DRAWINGS

When considered in connection with the following illustrative figures, a more complete understanding of the present invention may be derived by referring to the detailed description. In the figures, like reference numbers refer to like elements or acts throughout the figures.

Figure 1:
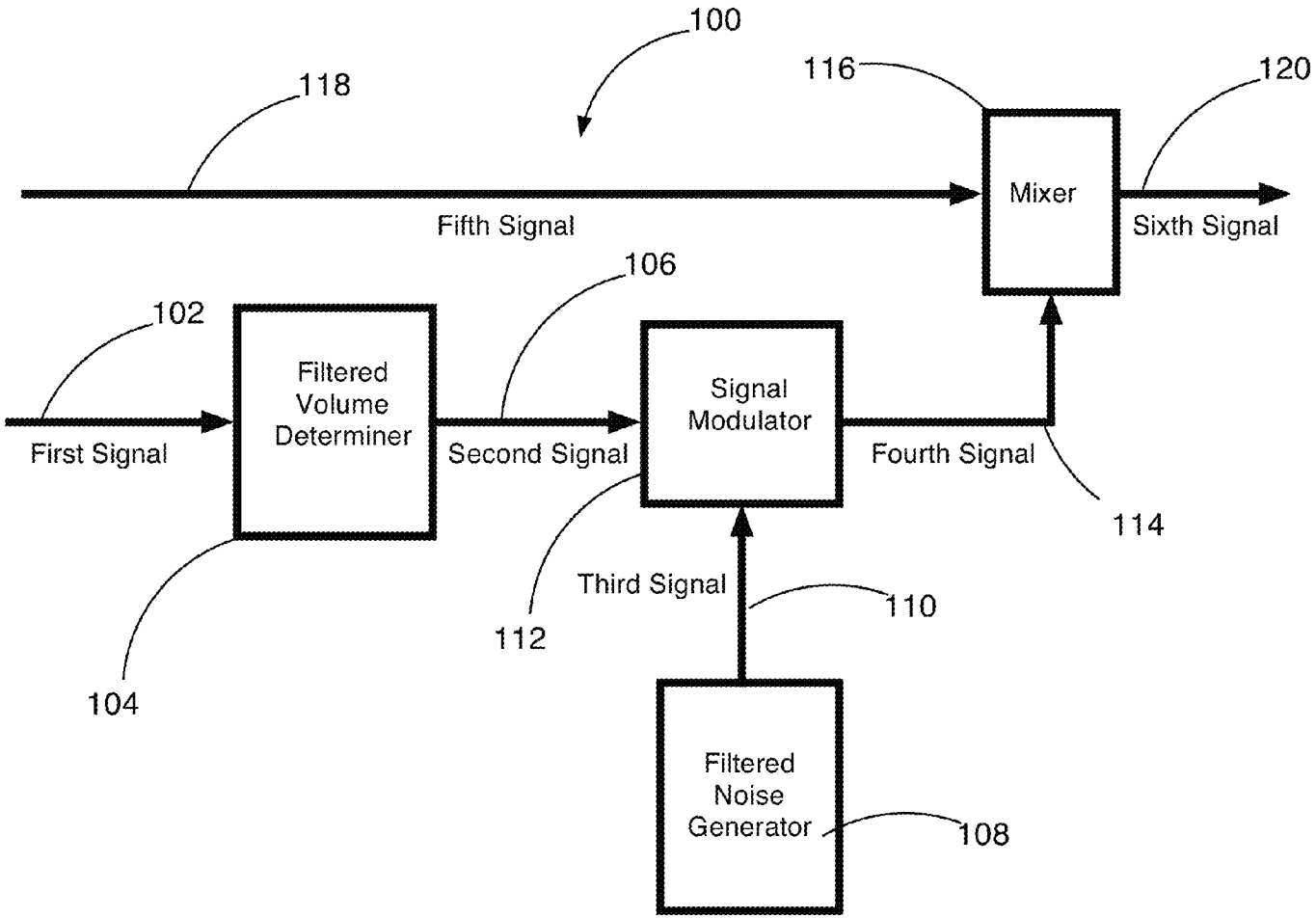
FIG. 1 is a schematic diagram of a first embodiment of an audio system for adding audible noise with time varying volume in accordance with the principles of the present invention.

Elements and acts in the figures are illustrated for simplicity and have not necessarily been rendered according to any particular sequence or embodiment.

DETAILED DESCRIPTION OF THE INVENTION

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. It is noted that the inventor can be his own lexicographer. The inventor expressly elects, as his own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims. For example, the term "noise" may refer to a sound signal of any kind as is known by those of ordinary skill in the art and thus may include a sound signal with a single fixed frequency and amplitude, warbled tones, chirping sounds, multiple tones, a combination of tones having random frequencies and random amplitudes, a random sound signal, "white noise," "pink noise," Brownian noise" (i.e., "red noise"), "Grey noise," and/or "hiss," as such terms are understood by those of skill in the art, uniformly distributed noise from a pseudo-random noise generator and the like. The terms "audio devices" or "audio systems" include, but are not limited to, hearing aids and personal sound amplification products as well as other devices and systems that could benefit from the teachings of the present invention, such as devices with limited audio bandwidth, televisions, radios, cell phones, computers, laptops, tablets, personal media players, and recording devices.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. §112, ¶6. Thus, the use of the words "function," "means" or "step" in the Detailed Description of the Invention or claims is not intended to somehow indicate a desire to invoke the special provisions of 35 U.S.C. §112, ¶6, to define the invention. To the contrary, if the provisions of 35 U.S.C. §112, ¶6 are sought to be invoked to define the inventions, the claims will specifically and expressly state the exact phrases "means for" or "step for" and the specific function (e.g., "means for filtering"), without also reciting in such phrases any structure, material or act in support of the function. Thus, even when the claims recite a "means for . . . " or "step for . . . " if the claims also recite any structure, material or acts in support of that means or step, or that perform the recited function, then it is the clear intention of the inventor not to invoke the provisions of 35 U.S.C. §112, ¶6. Moreover, even if the provisions of 35 U.S.C. §112, ¶6 are invoked to define the claimed inventions, it is intended that the inventions not be limited only to the specific structure, material or acts that are described in the illustrated embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. Thus, the full scope of the inventions is not limited to the examples that are described below.

Various aspects of the present invention may be described in terms of functional block components and various processing steps. Such functional blocks may be realized by any number of hardware or software components configured to perform the specified functions and achieve the various results. For example, exemplary embodiments of the present invention may employ various filters, e.g., a filtered volume determiner or a filtered noise generator, and the like, which may carry out a variety of functions. In addition, various aspects of the present invention may be practiced in conjunction with any number of audio devices, and the systems and methods described are merely exemplary applications for the invention. Further, exemplary embodiments of the present invention may employ any number of conventional techniques for audio filtering, noise generation, modulation, mixing and the like.

Various representative implementations of the present invention may be applied to any system for audio devices. Certain representative implementations may include, for example: hearing aid devices and personal sound amplification products. Methods and apparatus for audio devices may operate in conjunction with a system for adding audible noise with time varying volume.

Referring now to FIG. 1, a schematic diagram of a first audio system, generally indicated at 100, for adding audible noise with time varying volume in accordance with the principles of the present invention is shown. This first audio system 100 includes a filtered volume determiner 104, a filtered noise generator 108, a signal modulator 112, and a mixer 116. The filtered volume determiner 104 is configured to receive a first signal 102 corresponding to an audio signal. The filtered volume determiner 104 measures the time varying volume envelope of sounds where the individual has restricted sound perception. Thus, the filtered volume determiner 104 is configured to generate a second signal 106, which corresponds to a volume envelope for a first range of selected frequencies of the first signal 102. The filtered noise generator 108 is configured to generate a third signal 110 corresponding to audio noise substantially within a second range of selected frequencies that are audible to the particular user. The signal modulator 112 is in communication with the filtered volume determiner 104 and the filtered noise generator 108. The signal modulator 112 is provided to modulate the output 110 of the filtered noise generator 108 so that it is proportional to the measured time varying volume envelope. The mixer 116 is provided to add audible noise having the time varying volume envelope to the sixth audio signal 120.

The audio system 100 is thus configured to add audible noise with time varying volume by making the time varying volume envelope of the added audible noise proportional to the time varying volume envelope of sound for frequencies where an individual has a restricted range of perception. The audio system 100 can thus be utilized to improve the audibility, speech intelligibility, and word recognition characteristics of sound produced by an audio device that incorporates the audio system 100.

In various representative aspects of the present invention, a filtered volume determiner measures the time varying volume envelope of sounds where the individual has restricted sound perception, a filtered noise generator is used to create sounds that are audible to the individual, and a mixer is provided to add the audible noise having the time varying volume envelope to the audio signal.

Components that are in communication may be electronically coupled so as to be capable of sending and/or receiving electronic signals between electronically coupled components or linked so as to be capable of sending and/or receiving digital or analog signals between linked components. Coupling may be accomplished by hard wiring components, wireless communication between components, on-chip or on-board communications and the like. Alternately, coupling may be accomplished mechanically or optically with such devices as are known in the art such as integrated optics using surface acoustical waves and the like. The signal modulator 112 is configured to receive the second signal 106 from the filtered volume determiner 104. The signal modulator 112 is configured to receive from the filtered noise generator 108 the third signal 110. The signal modulator 112 is configured to generate a fourth signal 114 substantially similar to a product of a weighted second signal 106 and a weighted third signal 110, based on relative levels of the second signal 106 and third signal 110. A mixer 116 is coupled to the signal modulator 112. The mixer 116 is configured to receive the fourth signal 114 from the signal modulator 112. The mixer 116 is configured to receive a fifth signal 118 substantially similar to the first signal 102. The mixer 116 is configured to generate a sixth signal 120 substantially similar to a sum of a weighted fourth 114 signal and a weighted fifth signal 118, based on relative levels of the fourth signal 106 and fifth signal 110. Many electronic, optical and mechanical alternatives are possible to implement individual functions of the present invention. For example, the mixing function of the mixer 116 could be accomplished via simple air conduction acoustical mixing where the fourth signal 114 from the signal modulator 112 is an air conduction acoustical signal and the fifth signal 118 is the original air conduction audio signal. In this case the user would simply "hear" the air conduction mixing of both the original sound from the environment and the added audible noise with time varying volume. Alternately, software operating on a digital device may be used to implement individual functions of the present invention. Multiple instances of the first audio system 100 may be used in a single audio device. Multiple instances may require subdivision of the first range of selected frequencies of the first signal 102 and may require subdivision of the second range of selected frequencies of the third signal 110. Multiple instances of a first audio system 100 for a stereo audio device may contain a first instance of a first audio system 100 for a right channel and a second instance of a first audio system 100 for a left channel.

Figure 4:
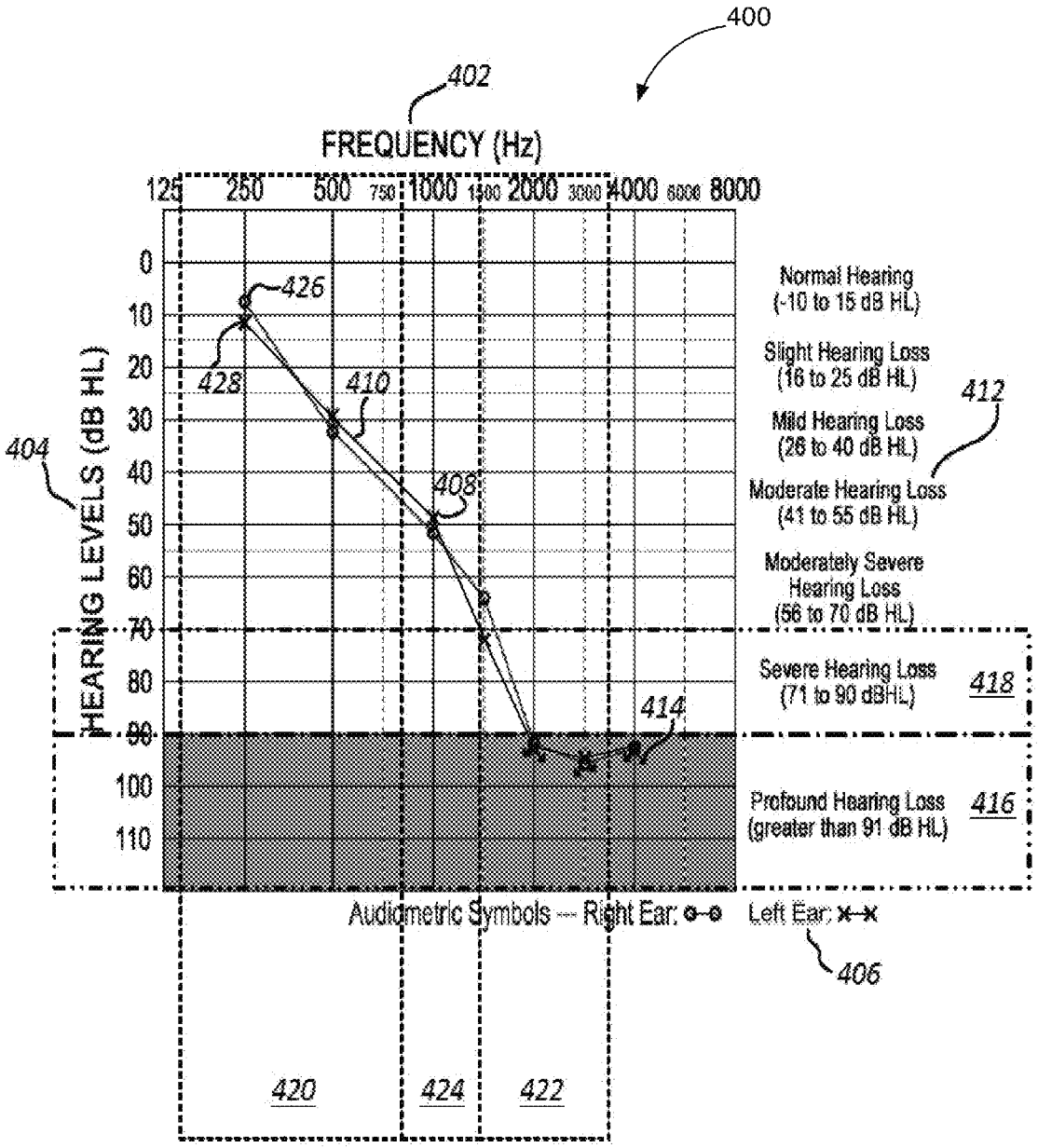
FIG. 4 is an audiogram for a specific individual having hearing loss.

Referring now to FIG. 4, an audiogram 400 for a specific individual having hearing loss is shown. The audiogram 400 is used to depict air conduction audiometric thresholds of hearing for the specific individual. Typically, air conduction audiometric thresholds are measured monaurally for a left ear and a right ear as a function of frequency 402 and hearing level 404. Hearing loss is measured in dB hearing level (dB HL) relative to a population of normal hearing individuals. A symbolic key 406 may be included in the audiogram 400 to assist with interpretation of recorded data. Typically an 'o' symbol is used to mark air conduction measurements recorded for the right ear and an 'x' symbol is used to mark air conduction measurements recorded for the left ear. The 'o' and 'x' marks are made on the audiogram at points corresponding to the test frequency presented to an individual and the associated measured air conduction audiometric thresholds. The 'x' symbol 408 is consequently interpreted in the audiogram 400 as a left ear audiometric threshold of approximately 48 dB HL for a presentation frequency of 1000 Hertz (Hz) for the specific individual. A line 410 is sometimes used to connect between recorded measurements. A key 412 may also be included indicating generally recognized descriptions of hearing loss and their associated audiometric range of hearing levels. Using the key 412, the "x" symbol 408 indicates a moderate hearing loss at 1000 Hz for the left ear. A small arrow 414 may be appended to the 'o' or 'x' audiometric symbols. The small arrow 414 generally represents that the specific individual gave no response to the test frequency stimulus and is often interpreted as frequency where the specific individual may have permanent auditory nerve damage. A profound hearing loss 416 is generally associated with permanent auditory nerve damage. In the region of profound hearing loss 416, an individual does not generally perceive specific frequencies or tones. A severe hearing loss 418 is characterized as having a severely restricted dynamic range and sounds having these frequencies can quickly change from being barely audible to being uncomfortably loud with only a small change in actual measured volume. In general, speech is spread across a wide range of frequencies spanning the frequency range 402 in the audiogram 400. Of special interest are frequencies below 800 Hz dominated by a vowel like sound 420 or frequencies above 1500 Hz which contain a consonant sound component 422. An intermediate frequency range 424 is also indicated. The audiogram 400 for the specific individual begins with air conduction measurements for a right ear 426 and a left ear 428. These air conduction measurements beginning for the right ear 426 and beginning for the left ear 428 would be unique for this specific individual and are used to illustrate in other figures filtering aspects used in accordance with the present invention. In general, each audiogram is unique for each individual. Consequently, the filtering requirements taught for the present invention for each individual may be changed to suit each individual's hearing loss. In general, an individual has a restricted range of perception where the individual has profound hearing loss or where the individual has severe hearing loss and profound hearing loss.

Figure 5:
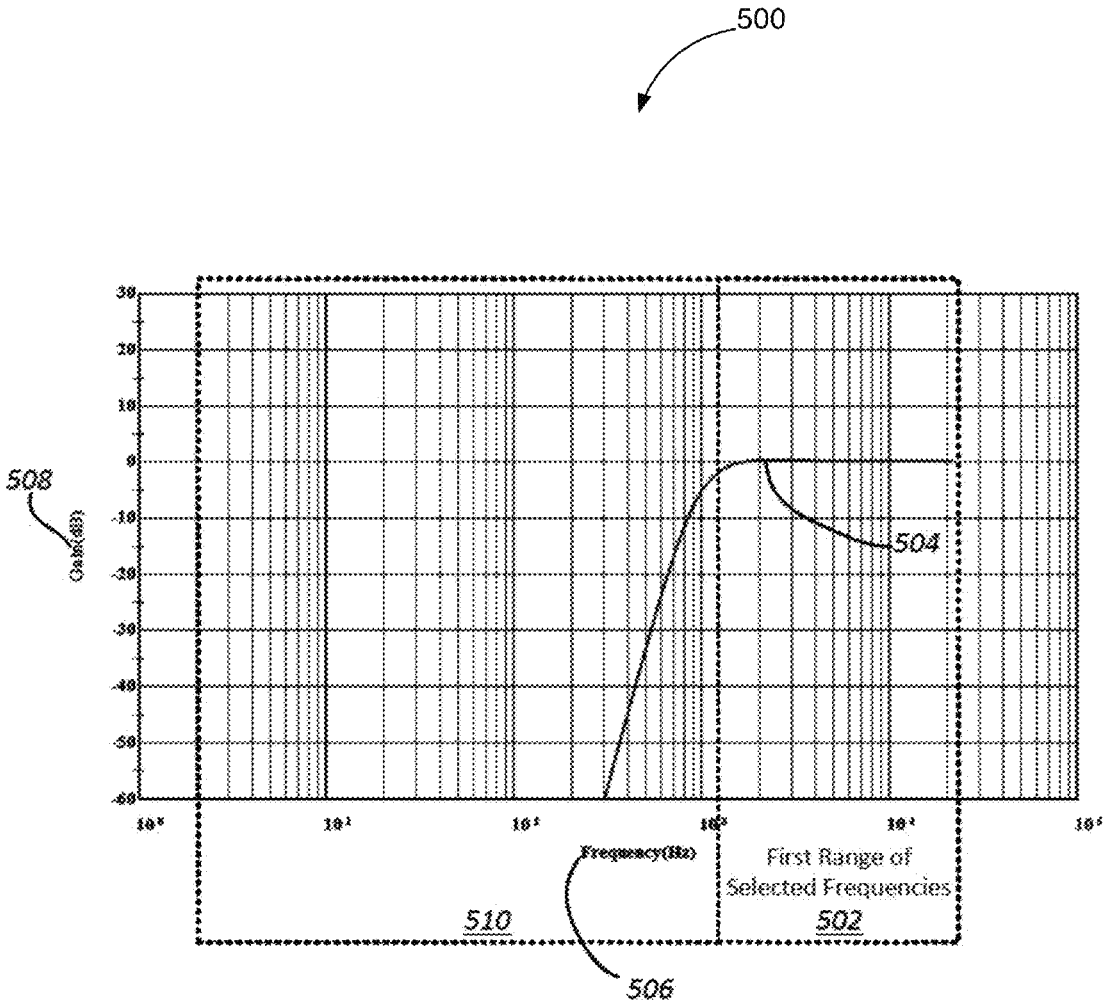
FIG. 5 is a graph of a gain versus frequency curve for a first range of selected frequencies in accordance with the principles of the present invention.

FIG. 5 depicts a frequency response graph 500 which may be used to indicate a first range of selected frequencies 502 for the filtered volume determiner 104 when configured for the specific individual with the audiogram 400 (see FIG. 4). Typically, the frequency response graph 500 indicates a frequency response 504 as a function of frequency 506 and gain 508. It is noted that negative gain is often referred to as attenuation. This particular frequency response 504 is equivalent to a series combination of three second-order high pass filters: two second-order Butterworth filters (filter parameters: Fc=1000 Hz, Q=0.707, Ripple=0.00 dB, Linear Scale=1.00) and one second-order Variable Q filter (filter parameters: Fc=900 Hz, Q=1.000, Ripple=0.00 dB, Linear Scale=1.00). These filter parameters were selected for the specific individual with the audiogram 400 so as to allow the filtered volume determiner 104 (see FIG. 1) to use the sound for the first range of selected frequencies 502 and to restrict the filtered volume determiner 104 from using other sound frequencies 510. By selecting these filter parameters; the filtered volume determiner 104 may generate a second signal 106 for sound frequencies where the specific individual with audiogram 400 has severe hearing loss 418 or profound hearing loss 416. For those skilled in the art, it should be evident that there are multiplicities of filter combinations, types, orders, and filter parameters that may be used to accomplish similar objectives for the first range of selected frequencies 502 for the generation of the second signal 106. For example, high pass filter types might also include Linkwitz-Riley, Bessel, Chebychev, Cauer (elliptic), and the like. Alternately, band pass filters of sufficient width could be used. Furthermore, one skilled in the art will realize that the filters may include active, passive, digital, analog, mechanical, delay line, or other filter technologies. In one embodiment of the present invention, the first range of selected frequencies 502 may be selected to correspond to each individual's unique hearing loss. Alternately, the first range of selected frequencies 502 may be determined by each individual's personal preference. In another embodiment of the present invention, frequencies defined by the consonant sound component 422 may be used to define a first range of selected frequencies 502. Multiple instances of the present invention within an audio device may require subdivision of the first range of selected frequencies 502. Other strategies for the determination of the first range of selected frequencies 502 should also be readily apparent to those individuals skilled in the art.

Figure 9:
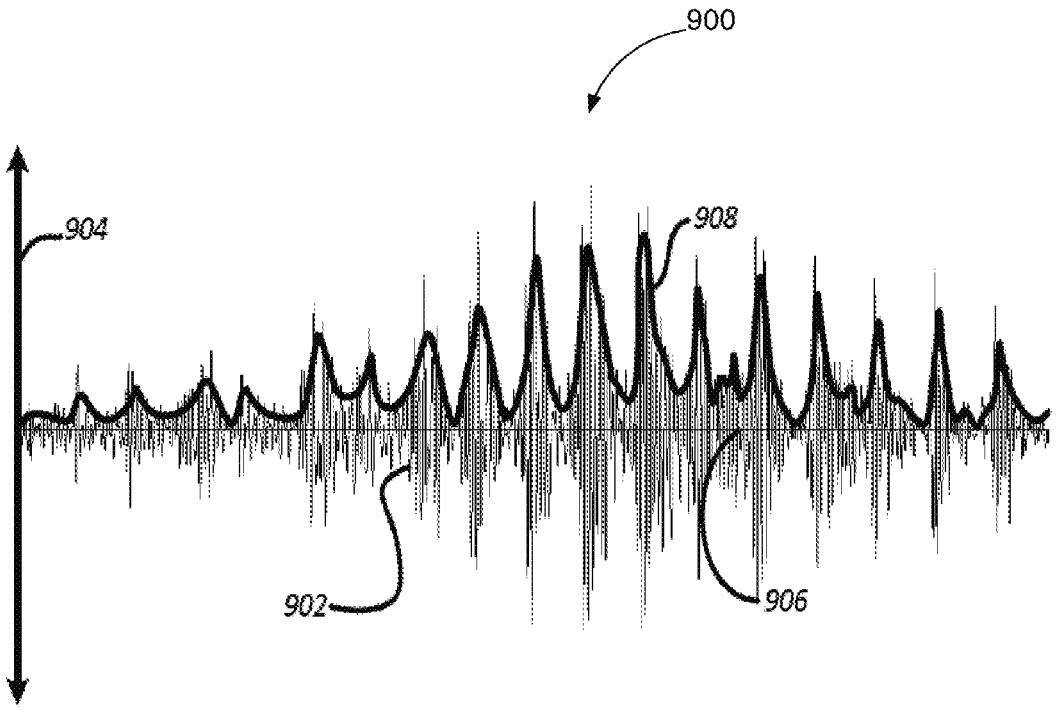
FIG. 9 is a graph of a speech waveform in accordance with the principles of the present invention.

Referring now to FIG. 9, a speech graph 900 shows a speech waveform 902 with an instantaneous sound pressure 904 plotted as function of time 906. The speech waveform 902 includes the first range of selected frequencies 502 (see FIG. 5) of the first signal 102 (see FIG. 1). The filtered volume determiner 104 generates the second signal 106 that is proportional to a volume envelope 908. According to the principles of the present invention, the volume envelope 908 may be determined using a digital signal processing technique typically associated with a peak detector processing component. Such a peak detector processing component is commonly used to provide input to a VU meter. The volume envelope 908 generated by the peak detector component may be an alpha-filtered absolute value of the speech waveform 902 over a time period. The time period corresponds to the property: alpha ($\alpha$). For a digital signal processing application, the second signal 106 may be indicated in terms of sample sets where the SecondSignal(n) is the current sample set at time (n) of the second signal 106, and SecondSignal(n−1) is the previous sample set at time (n−1) of the second signal 106. The absolute value of the current sample set for speech waveform 902 may be indicated as:

$$|\text{FilteredFirstSignal}(n)|$$

The volume envelope as determined using the peak detector component may be given by the following equation:

$$\text{SecondSignal}(n)=(1-\alpha)*[\text{SecondSignal}(n-1)]+\alpha*[|\text{FilteredFirstSignal}(n)|]$$

The time constant ($\tau$) of the volume envelope 908 as determined using the peak detector component may be given by the following equation:

$$\tau=-1/(fs*\ln(1-\alpha))$$

Where: fs is the sample frequency and ln is the natural logarithm.

As an example, for a sample frequency of 44100 Hz and a time constant ($\tau$) of 0.00025 seconds, the calculated $\alpha$=0.0867110349. The volume envelope 908 in speech graph 900 is illustrated to be only generally representative of any type of volume envelope that may represent the time varying volume signal. Those of skill in the art will appreciate that there are multiplicities of analog and digital means, methods, apparatus, approaches, and strategies to filter and otherwise generate the second signal 106 corresponding to a volume envelope 908 of the first range of selected frequencies 502 from the first signal 102.

Figure 6:
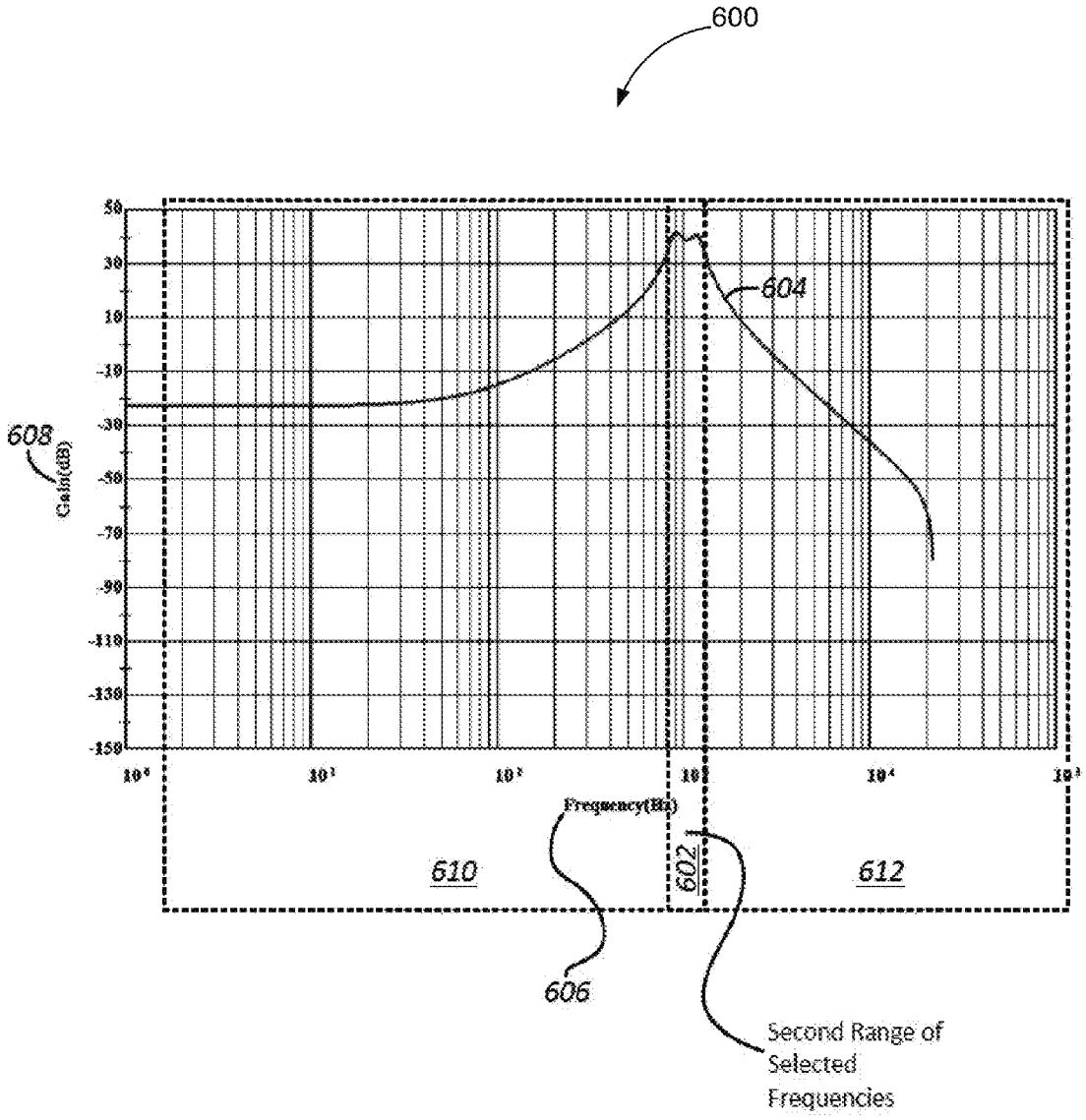
FIG. 6 is a graph of a gain versus frequency curve for a second range of selected frequencies in accordance with the principles of the present invention.

FIG. 6 depicts a frequency response graph 600 that may be used to indicate a second range of selected frequencies 602 for the filtered noise generator 108 (see FIG. 1) when configured for the specific individual with the audiogram 400 (see FIG. 4). The frequency response graph 600 indicates a frequency response 604 as a function of frequency 606 and gain 608. This particular frequency response 604 is equivalent to the series combination of three filters: a first Equalizer/Q Factor (filter parameters: Fc=1200 Hz, Gain=40.00 dB, Q=8.000, Ripple=0.00 dB, Linear Scale=0.48), a second Equalizer/Q Factor (filter parameters: Fc=900 Hz, Gain=40.00 dB, Q=8.000, Ripple=0.00 dB, Linear Scale=0.55), and a first-order low pass Butterworth filter (filter parameters: Fc=1200 Hz, Ripple=0.00 dB, Linear Scale=1.00). These filter parameters were selected for the specific individual with the audiogram 400 so as to allow the filtered noise generator 108 to generate sound noise for the second range of selected frequencies 602 and to restrict the filtered noise generator 108 from generating low frequency sound noise 610 and high frequency sound noise 612. By using these filter parameters, the filtered noise generator 108 may generate a third signal 110 for sound frequencies where the specific individual with audiogram 400 exhibits sound perception in the intermediate frequency range 424 (see FIG. 4). To those of skill in the art, it should be evident that there are multiplicities of filter combinations, types, orders, and filter parameters that may be used to accomplish similar objectives for the generation of the third signal 110. For example, band pass filters could be used. In one embodiment of the present invention, the second range of selected frequencies 602 may be selected to correspond to each individual's unique hearing loss. Alternately, the second range of selected frequencies 602 may be determined by each individual's personal preference.

In another embodiment of the present invention, frequencies defined by the intermediate frequency range 424 may be used to define the second range of selected frequencies 602. Multiple instances of the present invention within an audio device may require subdivision of the second range of selected frequencies 602. Other strategies for the determination of the second range of selected frequencies 602 should also be readily apparent to those individuals skilled in the art.

Figure 2:
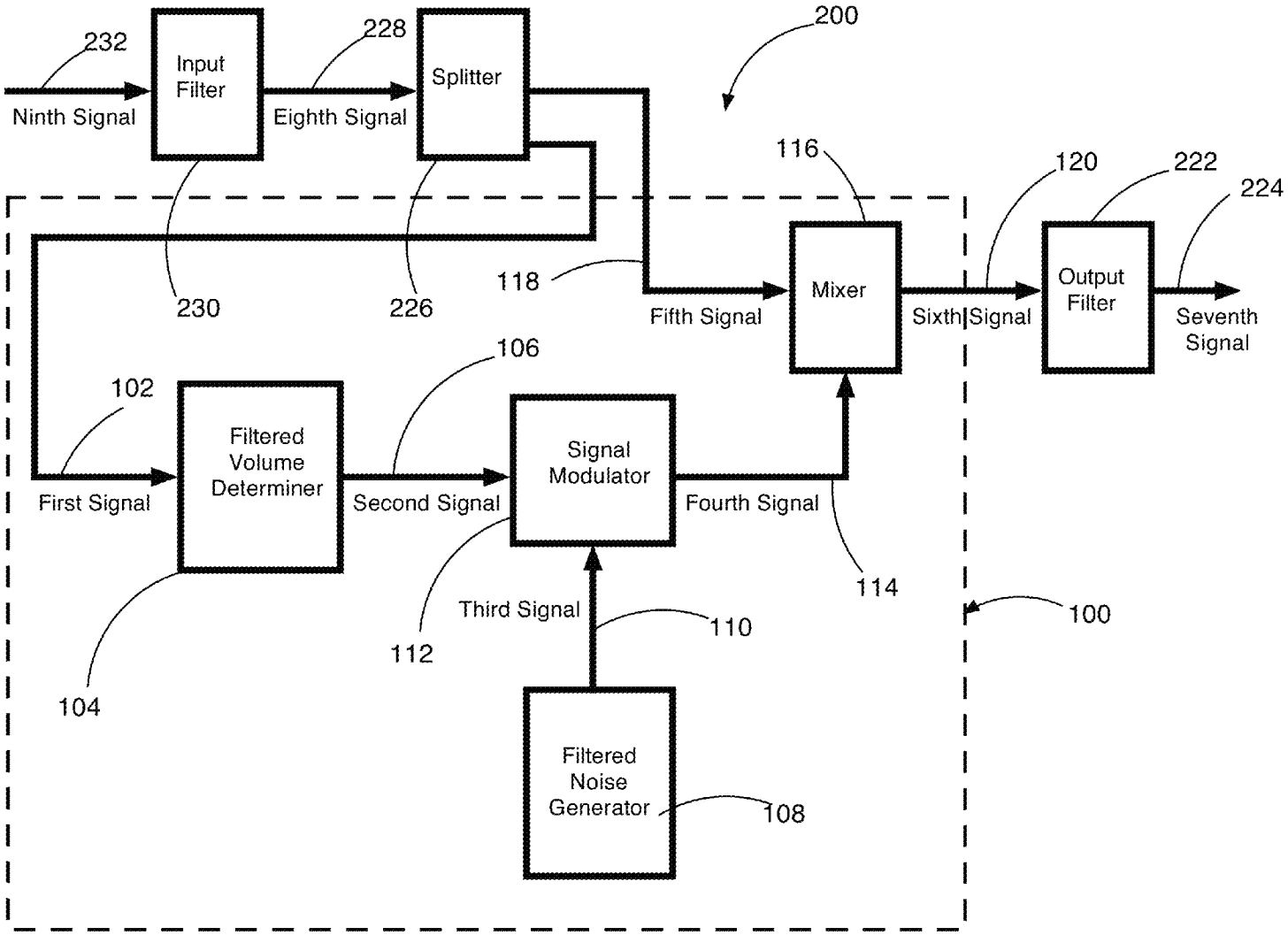
FIG. 2 is a schematic diagram of a second embodiment of an audio system for adding audible noise with time varying volume in accordance with the principles of the present invention.

Referring now to FIG. 2, a schematic diagram of a second audio system, generally indicated at 200, for adding audible noise with time varying volume in accordance with the principles of the present invention is shown. This second audio system 200 includes the components of the first audio system 100 (see FIG. 1) that is in communication with an output filter 222, a splitter 226 and an input filter 230. The output filter 222 is configured to receive the sixth signal 120 from the mixer 116. The output filter 222 is configured to generate a seventh signal 224 corresponding substantially to selected frequencies within a third range. The splitter 226 is configured to receive an eighth signal 228 from the input filter 230. The splitter 226 generates the first signal 102 that is substantially equivalent to the eighth signal 228. The splitter 226 generates the fifth signal 118 that is substantially equivalent to the eighth signal 228. The splitter 226 is coupled to the filtered volume determiner 104 to provide the first signal 102. The splitter 226 is coupled to the mixer 116 to provide the fifth signal 118. The input filter 230 is configured to receive a ninth signal 232 corresponding to an audio signal. The input filter 230 is configured to generate the eighth signal 228 that corresponds substantially to selected frequencies within a fourth range. Again, multiple instances of the second audio system 200 according to the present invention mat be used in an audio device such as a stereo audio device.

Figure 7:
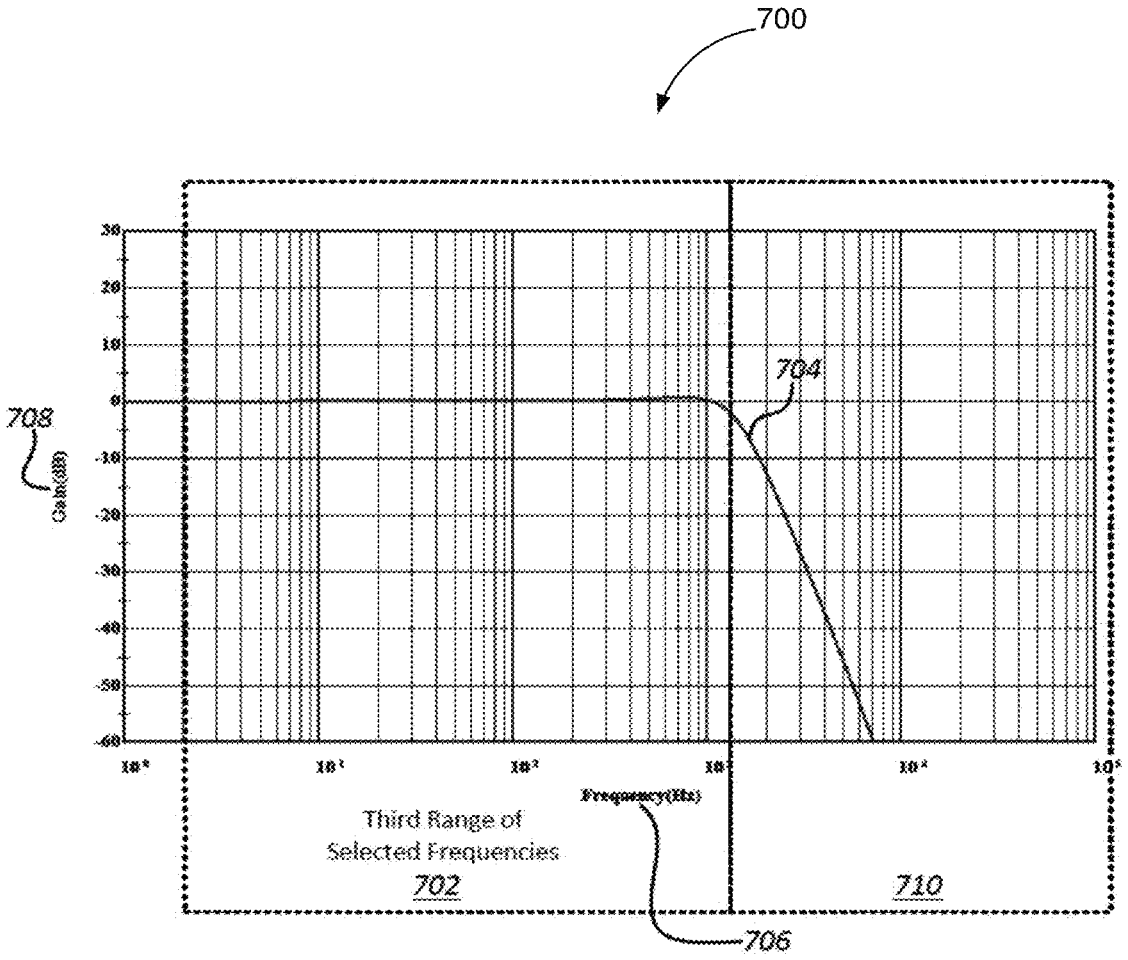
FIG. 7 is a graph of a gain versus frequency curve for a third range of selected frequencies in accordance with the principles of the present invention.

FIG. 7 depicts a frequency response graph 700 which may be used to indicate a third range of selected frequencies 702 for the output filter 222 when configured for the specific individual with the audiogram 400 (see FIG. 4). The frequency response graph 700 indicates a frequency response 704 as a function of frequency 706 and gain 708. This particular frequency response 704 is equivalent to a series combination of two second-order low pass filters: one second-order Butterworth filter (filter parameters: Fc=1400 Hz, Q=0.707, Ripple=0.00 dB, Linear Scale=1.00) and one second-order Variable Q filter (filter parameters: Fc=1400 Hz, Q=1.000, Ripple=0.00 dB, Linear Scale=1.00). These filter parameters were selected for the specific individual with the audiogram 400 so as to allow the output filter 222 (see FIG. 2) to pass sound for the third range of selected frequencies 702 and to restrict the output filter 222 from passing other sound frequencies 710. By selecting these filter parameters, the output filter 222 may generate a seventh signal 224 for sound frequencies where the specific individual with audiogram 400 has sound perception and restrict sound where the specific individual with audiogram 400 has severe hearing loss 418 or profound hearing loss 416. For those skilled in the art, it should be evident that there are multiplicities of filter combinations, types, orders, and filter parameters which may be used to accomplish similar objectives for the third range of selected frequencies 702 for the generation of the seventh signal 224. For example, low pass filter types might also include Linkwitz-Riley, Bessel, Chebychev, Cauer (elliptic), and the like. Alternately, band pass filters of sufficient width could be used. Furthermore, one skilled in the art will realize that the filters may include active, passive, digital, analog, mechanical, delay line, or other filter technologies. In one embodiment of the present invention, the third range of selected frequencies 702 may be selected to correspond to each individual's unique hearing loss. Alternately, the third range of selected frequencies 702 may be determined by each individual's personal preference. In another embodiment of the present invention, the output filter 222 may generate the seventh signal 224 with restricted sound frequencies in order to reduce total sound energy to satisfy NIOSH criteria for time dependent noise exposure which may consequently reduce additional noise induced hearing loss as indicated by the FDA's consumer warning for hearing aid users. In still another embodiment of the present invention, the output filter 222 may generate the seventh signal 224 with restricted sound frequencies in order to reduce sound without significant speech information content and thus assist word recognition in otherwise noisy sound environments. Other strategies for the determination of the third range of selected frequencies 702 should also be readily apparent to those individuals skilled in the art.

Figure 8:
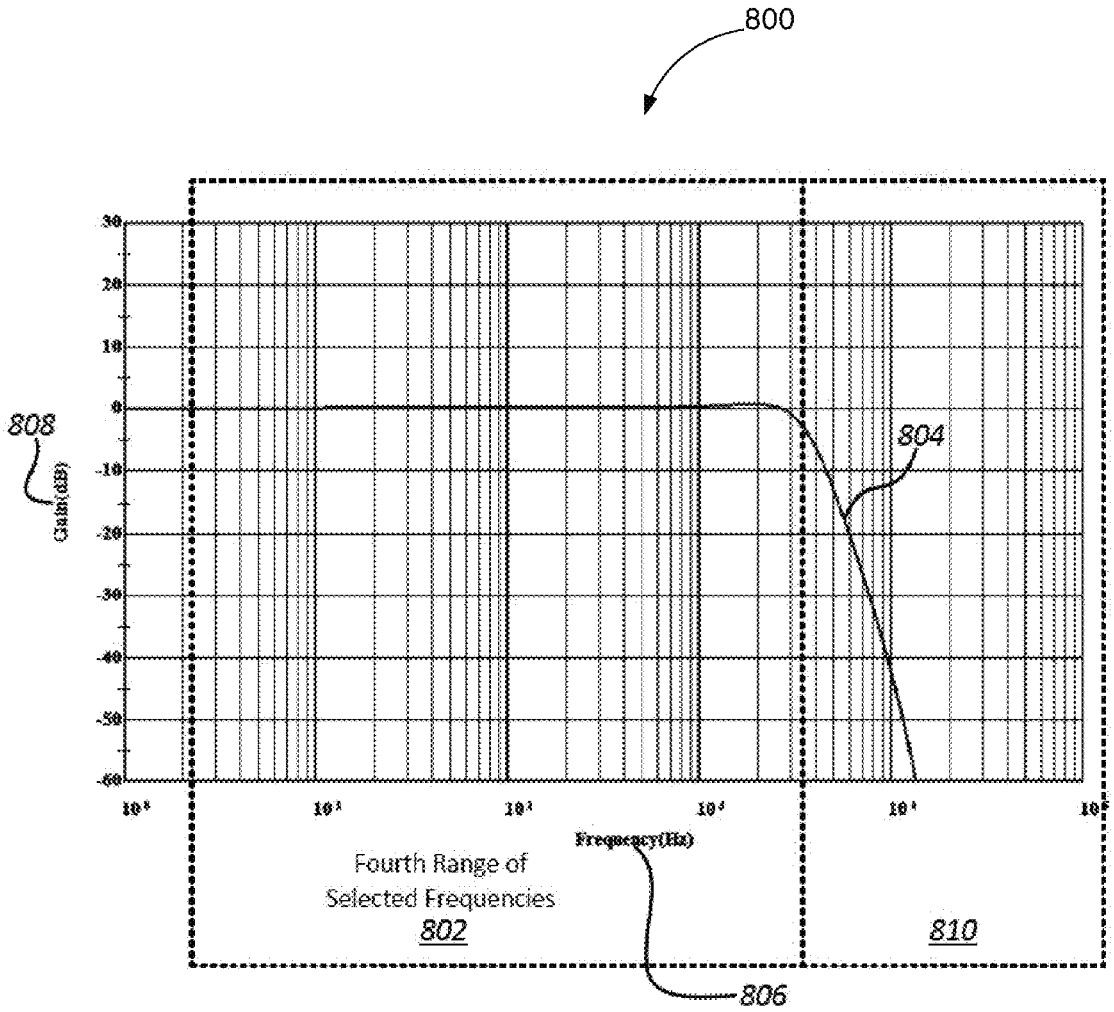
FIG. 8 is a graph of a gain versus frequency curve for depicts a fourth range of selected frequencies in accordance with the principles of the present invention.

FIG. 8 depicts a frequency response graph 800 that may be used to indicate a fourth range of selected frequencies 802 for the input filter 230 (see FIG. 2). The frequency response graph 800 indicates a frequency response 804 as a function of frequency 806 and gain 808. This particular frequency response 804 is equivalent to a series combination of two second-order low pass filters: one second-order Butterworth filter (filter parameters: Fc=3500 Hz, Q=0.707, Ripple=0.00 dB, Linear Scale=1.00) and one second-order Variable Q filter (filter parameters: Fc=3500 Hz, Q=1.000, Ripple=0.00 dB, Linear Scale=1.00). These filter parameters were selected so as to allow the input filter 230 to pass sound for the fourth range of selected frequencies 802 and to restrict the input filter 230 from passing other sound frequencies 810. By selecting these filter parameters; the input filter 230 may generate an eighth signal 228 for sound frequencies necessary for a person of normal hearing to achieve excellent speech intelligibility and word recognition. For those skilled in the art, it should be evident that there are multiplicities of filter combinations, types, orders, and filter parameters which may be used to accomplish similar objectives for the fourth range of selected frequencies 802 for the generation of the eighth signal 228. For example, low pass filter types might also include Linkwitz-Riley, Bessel, Chebychev, Cauer (elliptic), and the like. Alternately, band pass filters of sufficient width could be used. Furthermore, one skilled in the art will realize that the filters may include active, passive, digital, analog, mechanical, delay line, or other filter technologies. In one embodiment of the present invention, the fourth range of selected frequencies 802 may be selected to correspond to each individual's personal preference. In another embodiment of the present invention, the input filter 230 may generate the eighth signal 228 with restricted sound frequencies in order to reduce total sound energy that may consequently reduce noise induced hearing loss. Other strategies for the determination of the fourth range of selected frequencies 802 should also be readily apparent to those individuals skilled in the art.

Figure 3:
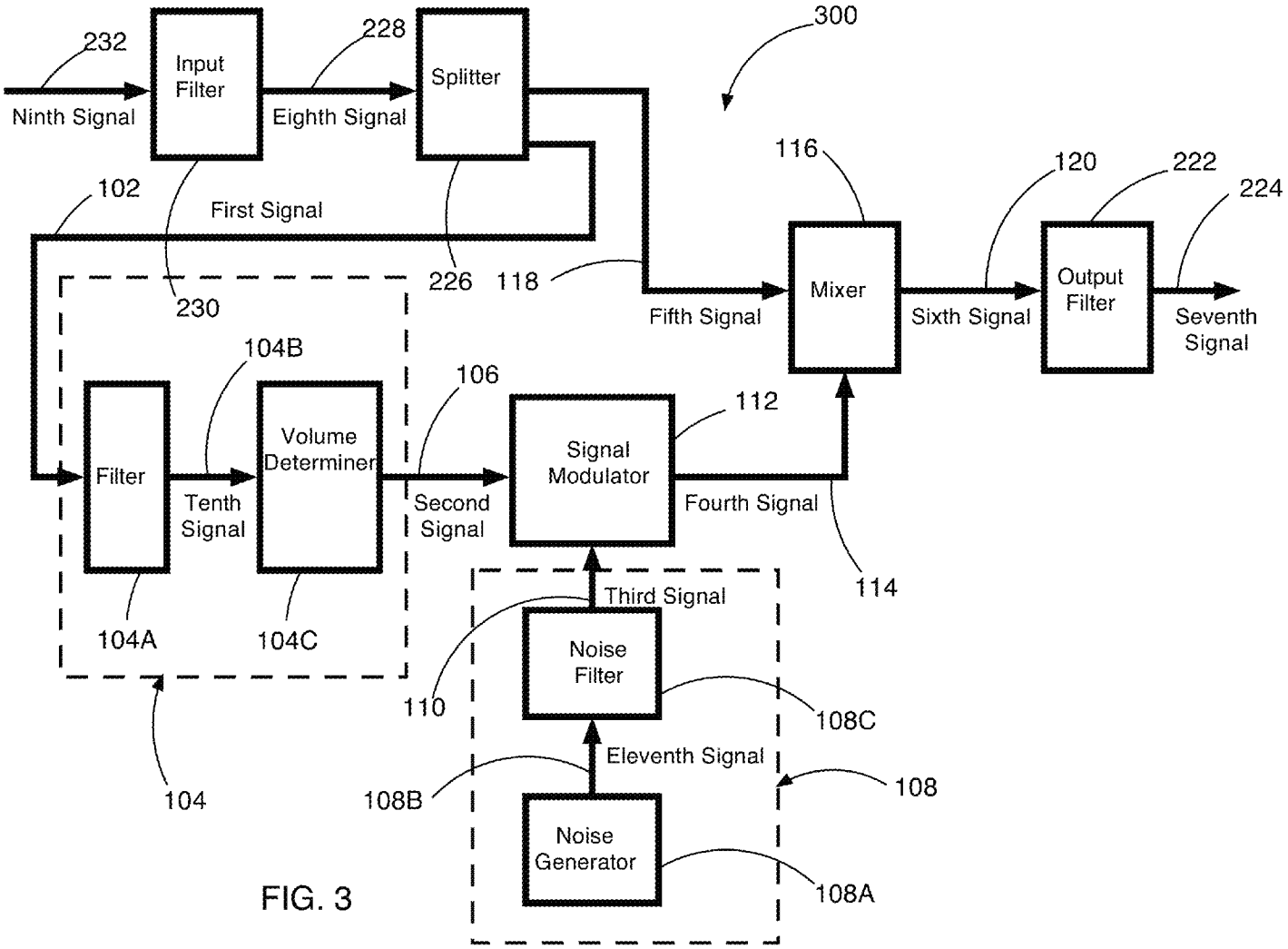
FIG. 3 is a schematic diagram of a third embodiment of an audio system for adding audible noise with time varying volume in accordance with the principles of the present invention.

Referring now to FIG. 3, a schematic diagram of a third audio system 300 for adding audible noise with time varying volume is shown. This third audio system 300 corresponds substantially to the second audio system 200 (see FIG. 2). In this embodiment, however, the filtered volume determiner 104 comprises a filter 104A coupled to a volume determiner 104C and the filtered noise generator 108 comprises a noise generator 108A coupled to a noise filter 108C. The filter 104A is configured to receive the first signal 102. The filter 104A is configured to generate a tenth signal 104B corresponding substantially to the first range of selected frequencies 502 (see FIG. 5) from the first signal 102. The volume determiner 104C is configured to receive the tenth signal 104B from the filter 104A. The volume determiner 104C is configured to generate the second signal 106, which is proportional to the volume envelope 908 (see FIG. 9) for the first range of selected frequencies 502 (see FIG. 5). The noise generator 108A is configured to generate an eleventh signal 108B corresponding to audio noise. The noise filter 108C is configured to receive the eleventh signal 108B. The noise filter 108C is configured to generate the third signal 110 corresponding to the audio noise of the eleventh signal 108B substantially within the second range of selected frequencies 602 (see FIG. 6) and restricted for low frequency sound noise 610 and high frequency sound noise 612. For those skilled in the art, it should be evident that there are multiplicities of rational, filter combinations, types, orders, filter parameters, and permutations which may be used to accomplish similar objectives to generate the second signal 106 and to generate the third signal 110. Furthermore, one skilled in the art will realize that the filters may include active, passive, digital, analog, mechanical, delay line, or other filter technologies. Again, multiple instances of a third audio system 300 may be used in an audio device such as a stereo audio device.

Figure 10:
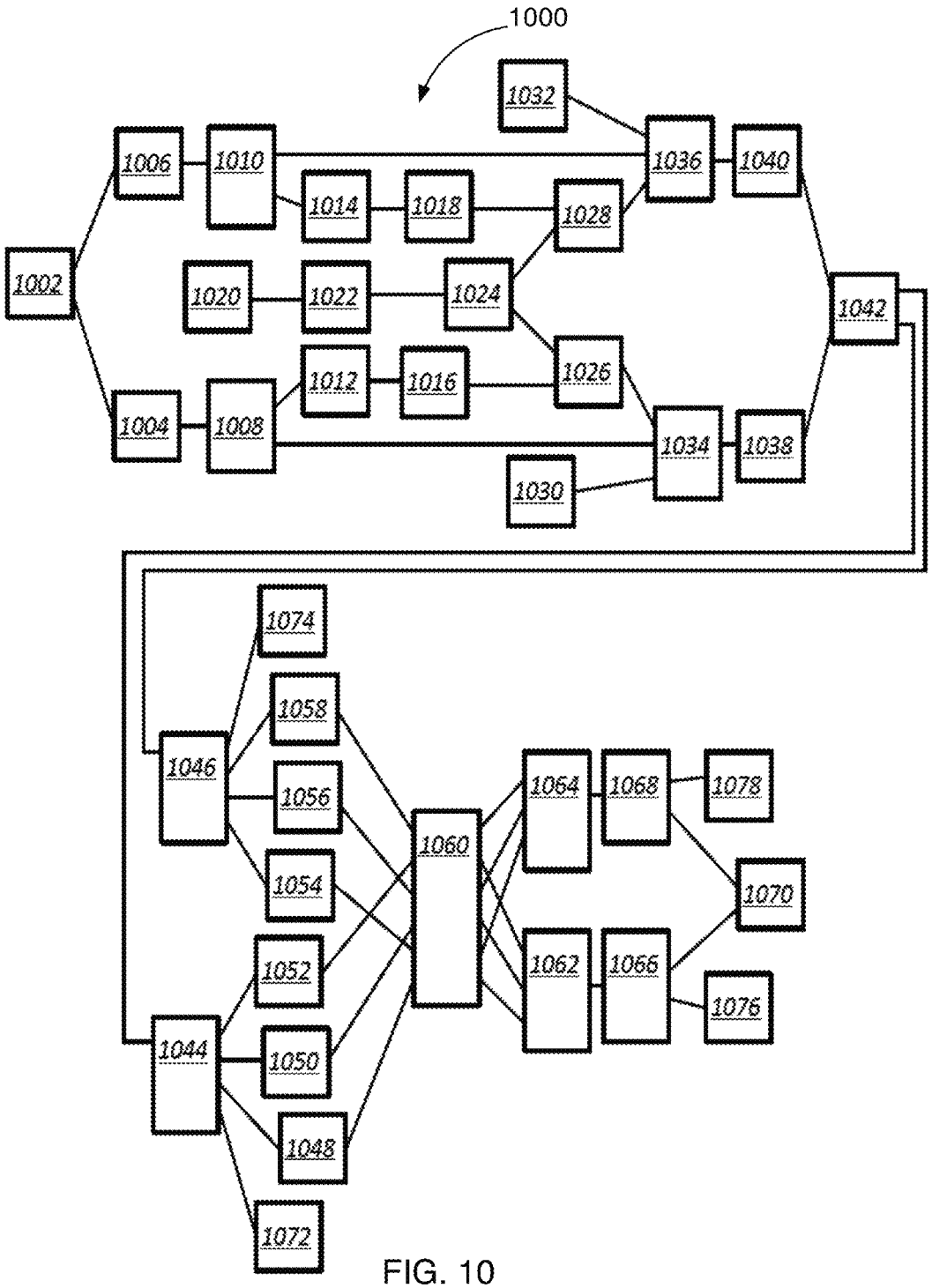
FIG. 10 is a schematic diagram of a fourth embodiment of an audio system for adding audible noise with time varying volume in accordance with the principles of the present invention.

Referring now to FIG. 10, a schematic block diagram of a fourth audio system, generally indicated at 1000, in accordance with the principles of the present invention for adding audible noise with time varying volume is shown. The schematic diagram of the fourth audio system 1000 is used to illustrate one of many possible implementations of the present invention. The schematic diagram of the fourth audio system 1000 illustrates a stereo body worn personal sound amplifier product. The fourth audio system 1000 may be implemented using a digital signal processor such as the Texas Instruments, Inc. Ultra Low Power Stereo Audio Codec With Embedded miniDSP—part number: TLV320AIC3254. The TLV320AIC3254 is described in Texas Instruments document number SLAS549A—SEPTEMBER 2008—REVISED OCTOBER 2008 (the entirety of which is herein incorporated by this reference). Lines used in FIG. 10 for the fourth audio system 1000 indicate signals configured to be coupled between the various numbered processing components. Processing components and their interconnections may be implemented using the Texas Instruments PurePath™ Studio for Portable Audio Version 5.40 Revision 12458 development tool: setup_PurePath_Studio_Portable_Audio_v5.40_build1_rev12458.exe (the entirety of which is herein incorporated by reference). The schematic diagram of the fourth audio system 1000 demonstrates one approach that uses software operating on a digital device to implement various functions and components of the present invention. An audio signal is received by a stereo decimation filter 1002. A first biquad filter 1004 receives the right stereo channel from the stereo decimation filter 1002. A second biquad filter 1006 receives the left stereo channel from the stereo decimation filter 1002. The first biquad filter 1004 and the second biquad filter 1006 perform the functions of the input filter 230 for the right and left stereo channels, respectively. A first splitter 1008 and a second splitter 1010 perform the functions of the splitter 226 (see FIG. 3) for the right and left stereo channels, respectively. A third biquad filter 1012 and a fourth biquad filter 1014 perform the functions of the filter 104A for the right and left stereo channels, respectively. A first peak detector 1016 and a second peak detector 1018 perform the functions of the volume determiner 104C for the right and left stereo channels, respectively. A noise source 1020 performs the function of the noise generator 108A. A fifth biquad filter 1022 performs the function of the noise filter 108C and provides the third signal 110 to a third splitter 1024. The third splitter 1024 generates substantially the same third signal 110 for both a first modulator 1026 and a second modulator 1028. The first modulator 1026 and the second modulator 1028 perform the functions of the modulator 112 for the right and left stereo channels, respectively. A right tone generator 1030 and a left tone generator 1032 may be used to provide "beeps" to the user to indicate such alerts as a program change, a low battery indicator, or an excessive time dependent noise exposure based on NIOSH criteria. The right tone generator 1030 and the left tone generator 1032 may be used to determine air conduction measurements, beginning for a right ear 426 and a left ear 428 (see FIG. 4), required to construct the audiogram 400 for a specific individual. The right tone generator 1030 and the left tone generator 1032 may also be used to determine a first range of selected frequencies 502 (see FIG. 5), a second range of selected frequencies 602 (see FIG. 6), or a third range of selected frequencies 702 (see FIG. 7) for a specific individual. These are important features. Many individuals have a condition known as "fluctuating hearing loss" and may benefit from built-in audiometric test and programming capabilities. Many individuals would also appreciate and benefit from an informed consent feature alerting them to excessive time dependent noise exposure and the associated possibility of further noise induced hearing loss. A first mixer 1034 and a second mixer 1036 perform the functions similar to the mixer 116 (see FIG. 3) for the right and left stereo channels, respectively. In this case, the first mixer 1034 and the second mixer 1036 also mix in the signals from the weighted right tone generator 1030 and the weighted left tone generator 1032 for the right and left stereo channels, respectively. A sixth biquad filter 1038 and a seventh biquad filter 1040 perform the functions of the output filter 222 for the right and left stereo channels, respectively. In the architecture of the TLV32AIC3254, for example, there exists two digital signal processors called a DSPA and a DSPD. The component 1042 passes signals between the DSPA and the DSPD as is required to fully utilize the capabilities of the TLV32AIC3254 for the right and left stereo channels, respectively.

The remaining components indicated in FIG. 10 perform the other tasks necessary for the fourth audio system 1000 to be used as the body worn personal sound amplifier product as will be understood by those skilled in the art. A fourth splitter 1044 and a fifth splitter 1046 are used to generate multiple copies of the right and left stereo channels, respectively. An eighth biquad filter 1048, a ninth biquad filter 1050, and a tenth biquad filter 1052 are used to generate individual frequency channels for the right stereo channel. An eleventh biquad filter 1054, a twelfth biquad filter 1056, and a thirteenth biquad filter 1058 are used to generate individual frequency channels for the left stereo channel. A stereo dynamic range compressor 1060 is used to perform amplification and compression tasks for the right and left stereo channels, respectively. A third mixer 1062 and a fourth mixer 1064 weigh and combine the individual frequency channels for the right and left stereo channels, respectively. A sixth splitter 1066 and a seventh splitter 1068 are used to generate copies of the right and left stereo channels, respectively. A stereo interpolator 1070 generates an audio output for the right and left stereo channels, respectively. A first spectrum analyzer 1072 and a second spectrum analyzer 1074 may be used as sound energy meters to perform tasks of a hearing aid analyzer as is known in the art. A third spectrum analyzer 1076 and a fourth spectrum analyzer 1078 may be used as sound energy meters to monitor the user's overall noise exposure and used to indicate a visual and/or audio warning when NIOSH noise exposure criteria has been exceeded.

The fourth audio system 1000 for adding audible noise with time varying volume shown in FIG. 10 may also be implemented monaurally using the TLV320AIC3254 with modifications as should be obvious to one skilled in the art. Similarly, other digital signal processors such as the ON Semiconductor® Ezairo™ 5900 or the Sound Design Technologies VOYAGEUR® platform may be used. One skilled in the art will recognize many similar implementations are possible with a variety of digital signal processors and microcontrollers or with configurations using analog components or with a combination of digital and analog components. Thus, the schematic diagram of the fourth audio system 1000 is used to illustrate one of many possible implementations of the present invention.

Figure 11:
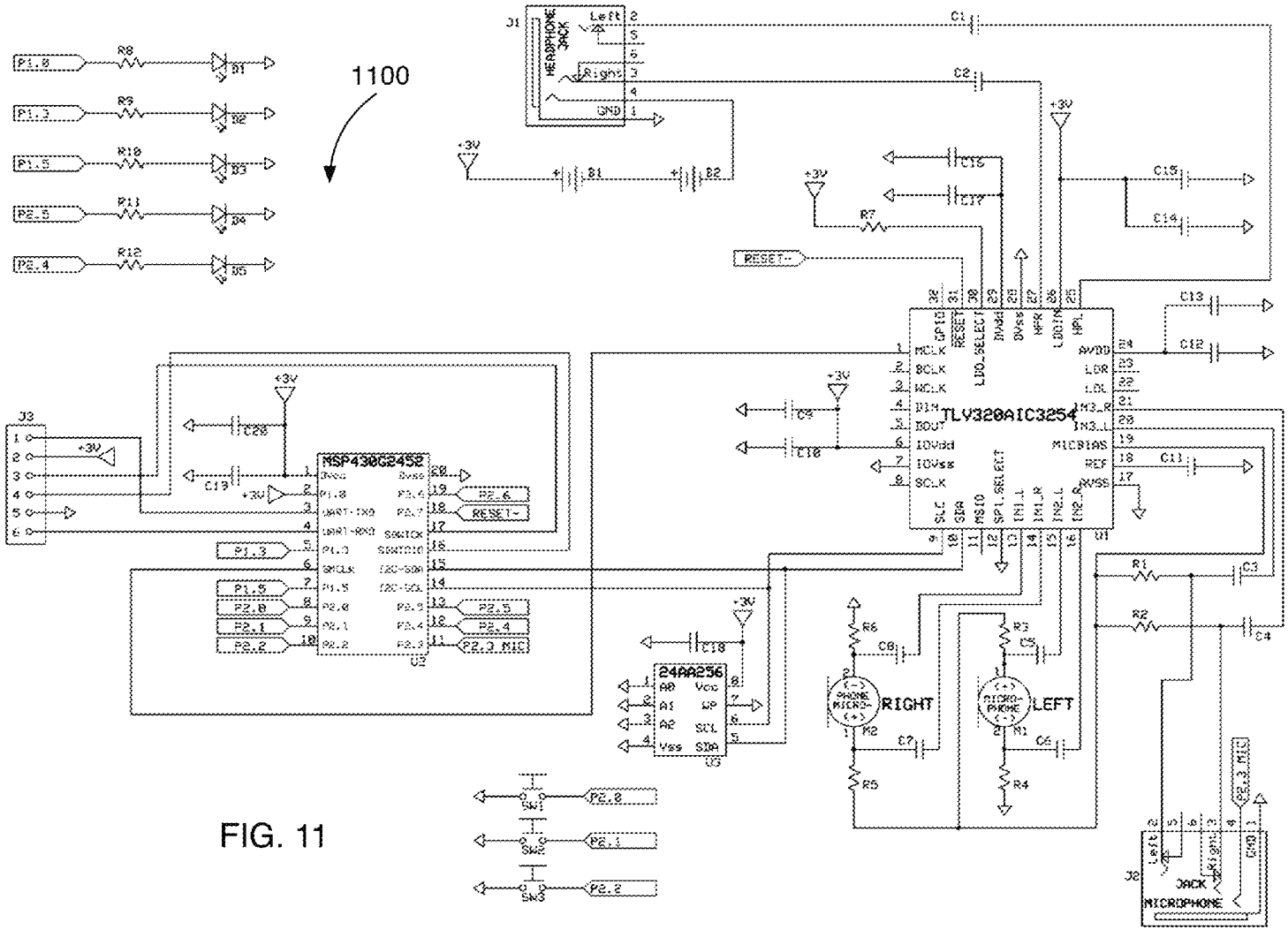
FIG. 11 depicts a schematic diagram of a fifth embodiment of an audio system for adding audible noise with time varying volume in accordance with the principles of the present invention.

Referring now to FIG. 11, a schematic diagram of a fifth audio system, generally indicated at 1100, for adding audible noise with time varying volume in accordance with the principles of the present invention is shown. The schematic diagram of the fifth audio system 1100 is used to illustrate one of many possible implementations of the present invention. The schematic diagram of the fifth audio system 1100 illustrates a stereo body worn personal sound amplifier product using a Texas Instruments, Inc. Ultra Low Power Stereo Audio Codec With Embedded miniDSP: TLV320AIC3254 U1. The TLV320AIC3254 U1 implements the schematic diagram of the fourth audio system 1000 (see FIG. 10). Electrical connections are made to the TLV320AIC3254 U1 per data sheet instructions and are as known to those skilled in the art. A left unidirectional electret microphone M1 and a right unidirectional electret microphone M2 provide for left and right audio sound input. Provisions are also made for additional microphones such as a stereo lapel microphone or a shotgun microphone through the microphone jack J2. Note that the microphone jack is also used to detect when a microphone is plugged-in with pin 4 of the microphone jack J2. Earphones are connected to the TLV320AIC3254 U1 using a headphone jack J1. A first AAA battery B1 and a second AAA battery B2 are used to power the fifth audio system 1100. The headphone jack J1 is also used as a master power switch and reset by the second AAA battery B2 connection made to pin 4 of the headphone jack J1. A Texas Instruments, Inc. Mixed Signal Microcontroller MSP430G2452 U2 is used to program and control the TLV320AIC3254 U1. The MSP430G2452 is described in Texas Instruments document number SLAS720D—DECEMBER 2010—REVISED AUGUST 2011 (the entirety of which is herein incorporated by this reference). This Microcontroller MSP430G2452 U2 uses an I2C bus to communicate with the TLV320AIC3254 U1 and a 256K EEPROM U3. The 256K EEPROM U3 is used for additional data and program storage. The Microcontroller MSP430G2452 U2 also provides Spy-Bi-Wire and UART communication interface through the interface connector J3. A first button SW1, a second button SW2, and a third button SW3 provide the user with a tactile interface. A first light emitting diode D1, a second light emitting diode D2, a third light emitting diode D3, a fourth light emitting diode D4, and a fifth light emitting diode D5 provide the user with visual feedback concerning system operation. The Microcontroller MSP430G2452 U2 monitors the third spectrum analyzer 1076 and the fourth spectrum analyzer 1078 components of the TLV320AIC3254 U1 to determine total time dependent sound energy exposure and provides visual or audible feedback to the user when NIOSH noise exposure criteria has been exceeded. A resistor R1 through a resistor R12 provide for voltage and current control to the various devices to which they are attached. A capacitor C1 through a capacitor C20 provide for direct current blockage or electronic noise suppression to the devices to which they are attached. The resistor and capacitor connections and component values may agree with data sheet application note suggestions. The fifth audio system 1100 is presented as one embodiment incorporating the principles of the present invention. Those skilled in the art should readily see that other digital signal processors, microcontrollers, and other devices may be used or incorporated to practice the present invention. For example, the present invention could be completely practiced with nothing but analog components such as passive components and operational amplifiers or transistors.

Figure 12:
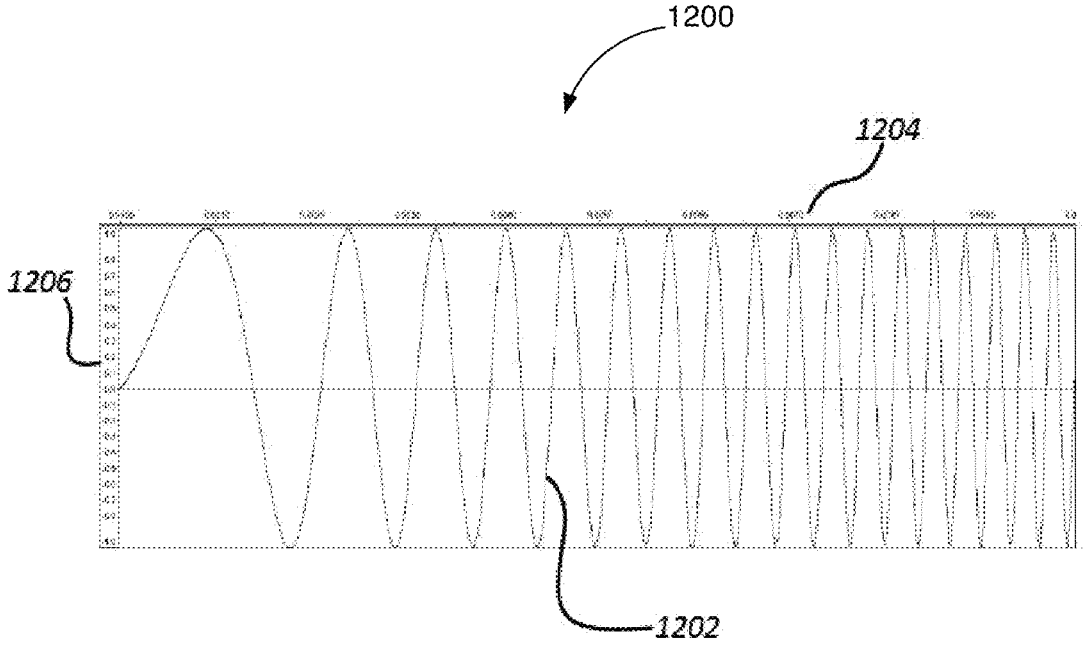
FIG. 12 is a graph of an audio signal with time varying frequency volume in accordance with the principles of the present invention.

FIG. 12 depicts an audio signal graph 1200. The audio signal graph 1200 includes a representation of an audio signal 1202 that is a function of time 1204 and amplitude 1206. The frequency of audio signal 1202 is shown to increase as time 1204 increases. An audio signal with properties similar to the audio signal 1202 may be used to customize the fifth audio system 1100 (see FIG. 11) for adding audible noise with time varying volume for a user. A method for customization is illustrated as follows. For example, the user of the device presses the appropriate tactile interface buttons such as the first button SW1 or the second button SW2, to adjust the overall listening volume of the audio device to a comfortable listening level for speech. Pressing a third button SW3 initiates a process where the microcontroller MSP430G2452 U2 causes the right tone generator 1030 or the left tone generator 1032 of the TLV320AIC3254 U1 to present a tone proportional to the previously selected comfortable listening level. The frequency of the presented tone is changed slowly as a function of time. The user of the device then presses and holds down the third button SW3 when he first hears the tone and releases the third button SW3 when the tone disappears. The frequency bands which are audible to the user are recorded by the microcontroller MSP430G2452 U2 and used to calculate the first range of selected frequencies 502 (see FIG. 5), the second range of selected frequencies 602 (see FIG. 6), and the third range of selected frequencies 702 (see FIG. 7). In this example, accurate measurement of audiometric thresholds at specific frequencies is not required to customize the fifth audio system 1100 where the user has a restricted range of perception. Rather, less accurate estimates associated with user's preferred listening level may be used to infer the appropriate amplification and compression requirements of the fifth audio system 1100 as is known by those skilled in the art. Amplification of sound where the user has restricted perception is avoided and sharp sounds at these frequencies are eliminated. Loop gain greater than unity is avoided and high frequency squealing is eliminated. The total noise exposure is reduced helping to satisfy NIOSH criteria. Thus, the relatively simple task of pressing a button while a frequency varying sound is heard may allow an unsophisticated user to program his audio device in order to achieve substantial benefit without requiring hearing healthcare professional assistance. This is a benefit for those individuals with fluctuating hearing loss. Those skilled in the art will recognize that there are many similar means available to perform essentially similar customization tasks that are made possible by the present invention. For example, in another approach, a fixed frequency tone of a slightly higher frequency could be played each time the first button SW1 is pressed while the third button SW3 is also pressed. Likewise, a fixed frequency tone of a slightly lower frequency could be played each time the second button SW2 is pressed while the third button SW3 is simultaneously pressed. With this approach, the user could immediately sense and adapt the audio device to a change in the user's range of audible frequencies. Those skilled in the art will also recognize that the present invention will be further enhanced by precision hearing measurement and fitting using data derived from binaural balance measurements (see United States Patent Application Pending Publication Numbers: US-2010-00310101-A1, US-201100019846-A1, and US-2011-0075853-A1, the entirety of each of which is incorporated by this reference).

Figure 13:
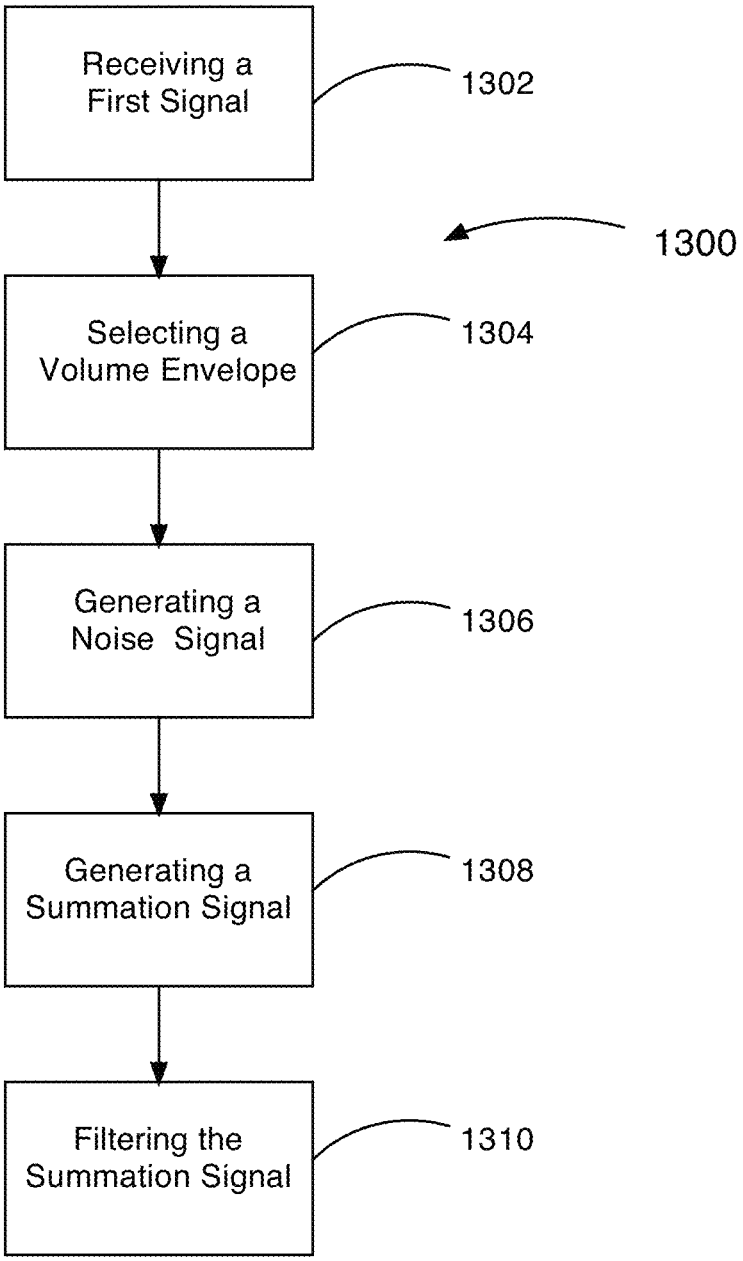
FIG. 13 is a schematic diagram of a method for adding a noise signal to an audio signal in accordance with the principles of the present invention.

As further illustrated in FIG. 13, the present invention further provides a method, generally indicated at 1300, for adding a noise signal to an audio signal. The method comprises receiving 1302 a first signal and selecting 1304 from the first signal, a volume envelope corresponding to sound intensities of a first range of frequencies. The method further comprises generating 1306 a noise signal, wherein the noise signal corresponds to noise substantially within a second range of frequencies. A modulated noise signal is then generate where the modulated noise signal is substantially proportional to the product of the noise signal multiplied by the volume envelope. A summation signal is subsequently generated 1308. The summation signal is substantially proportional to the sum of a weighted modulated noise signal and a weighted first signal.

The first range and second range of frequencies may be selected as a function of the user's hearing loss. Likewise, the first range of selected frequencies may be selected from frequencies for which a user's audiometric thresholds exceed a threshold for audiometric hearing loss or a threshold for severe hearing loss. Similarly, the second range of frequencies may be selected from frequencies for which a user's audiometric thresholds are less than a threshold for profound hearing loss or less than a threshold for severe hearing loss.

The noise signal is generated 1306 from distributed audio frequencies. The summation signal is then filtered 1310 to generate 1312 an output signal comprised of a third range of frequencies. The third range of frequencies is selected as a function of the user's hearing loss. At the beginning of the process, the first signal may be filtered to generate an input signal that is substantially within a fourth range of frequencies where the fourth range of frequencies is a function of frequencies used for speech. The method also provides an audible or visual warning to the user when time dependent noise exposure criteria has equaled or exceeded a predetermined amount.

In the foregoing specification, the present invention has been described with reference to specific exemplary embodiments. Various modifications and changes may be made, however, without departing from the spirit and scope of the present invention as set forth in the claims. The specification and figures are illustrative, not restrictive, and modifications are intended to be included within the scope of the present invention. Accordingly, the scope of the present invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages, and solutions to problems have been described above with regard to particular embodiments. Any benefit, advantage, solution to problem, or any element that may cause any particular benefit, advantage, or solution to occur or to become more pronounced are not to be construed as critical, required, or essential features or components of any or all the claims.

The terms "comprise", "comprises", "comprising", "having", "including", "includes" or any variations of such terms, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials, or components used in the practice of the present invention, in addition to those not specifically recited, may be varied or otherwise particularly adapted to specific environments, manufacturing specifications, design parameters, or other operating requirements without departing from the general principles of the same.

What is claimed is:

1. An audio system, comprising:

a filtered volume determiner configured to receive a first signal, wherein the filtered volume determiner is configured to generate a second signal corresponding to a volume envelope for a first range of selected frequencies of the first signal;

a filtered noise generator configured to generate a third signal corresponding to noise substantially within a second range of selected frequencies;

a signal modulator, coupled to the filtered volume determiner and to the filtered noise generator, wherein the signal modulator is configured to receive from the filtered volume determiner the second signal, and wherein the signal modulator is configured to receive from the filtered noise generator the third signal, and wherein the signal modulator is configured to generate a fourth signal substantially similar to a product of a weighted second signal and a weighted third signal;

a mixer, coupled to the signal modulator, wherein the mixer is configured to receive from the signal modulator the fourth signal, and wherein the mixer is configured to receive a fifth signal substantially similar to the first signal, and wherein the mixer is configured to generate a sixth signal substantially similar to a sum of a weighted fourth signal and a weighted fifth signal, and an output filter coupled to the mixer to receive the sixth signal and generate a seventh signal substantially within a third range of selected frequencies.

2. The audio system of claim 1, wherein the first range of selected frequencies is selected as a function of a user's hearing loss.

3. The audio system of claim 1, wherein the first range of selected frequencies comprises frequencies for which a user's audiometric thresholds exceed a threshold for profound hearing loss.

4. The audio system of claim 1, wherein the first range of selected frequencies comprises frequencies for which a user's audiometric thresholds exceed a threshold for severe hearing loss.

5. The audio system of claim 1, wherein the first range of selected frequencies is determined by a user.

6. The audio system of claim 1, wherein the second range of selected frequencies is selected as a function of a user's hearing loss.

7. The audio system of claim 1, wherein the second range of selected frequencies comprises frequencies for which a user's audiometric thresholds are less than a threshold for profound hearing loss.

8. The audio system of claim 1, wherein the second range of selected frequencies comprises frequencies for which a user's audiometric thresholds are less than a threshold for severe hearing loss.

9. The audio system of claim 1, wherein the second range of selected frequencies is determined by a user.

10. The audio system of claim 1, wherein the filtered volume determiner comprises a filter coupled to a peak detector, and wherein the filter is configured to receive the first signal and generate a tenth signal, and wherein the peak detector is configured to receive the tenth signal and generate the second signal.

11. The audio system of claim 10, wherein the filter comprises a high-pass filter or a band-pass filter.

12. The audio system of claim 10, wherein the peak detector receives the tenth signal, and wherein the peak detector generates the second signal which is an alpha-filtered absolute value of the tenth signal over a time period.

13. The audio system of claim 1, wherein the filtered noise generator comprises a noise generator coupled to a noise filter, and wherein the noise generator generates an eleventh signal, and wherein the noise filter is configured to receive the eleventh signal and generate the third signal.

14. The audio system of claim 13, wherein the noise generator generates a signal comprised substantially of distributed audio frequencies.

15. The audio system of claim 13, wherein the noise filter comprises a high-pass filter or a band-pass filter.

16. The audio system of claim 1, wherein the output filter is a low-pass filter.

17. The audio system of claim 1, wherein the third range of selected frequencies is selected as a function of a user's hearing loss.

18. The audio system of claim 1, wherein the third range of selected frequencies comprises frequencies for which a user's audiometric thresholds are less than a threshold for profound hearing loss.

19. The audio system of claim 1, wherein the third range of selected frequencies comprises frequencies for which a user's audiometric thresholds are less than a threshold for severe hearing loss.

20. The audio system of claim 1, wherein the third range of selected frequencies is determined by a user.

21. The audio system of claim 1, wherein a splitter is configured to receive an eighth signal, and wherein the splitter generates the first signal and the fifth signal, and wherein the first signal, the fifth signal and the eighth signal are all substantially similar.

22. The audio system of claim 21, wherein an input filter is coupled to receive a ninth signal and generate the eighth signal substantially within a fourth range of selected frequencies.

23. The audio system of claim 22, wherein the input filter is a low-pass filter.

24. The audio system of claim 22, wherein the fourth range of selected frequencies is selected as a function of frequencies used for speech.

25. The audio system of claim 1, wherein an audible or visual warning is provided to the user of the system indicating that time dependent noise exposure criteria has equaled or exceeded a predetermined amount.

26. The audio system of claim 1, wherein the first range of selected frequencies is dominated by consonant sound components.

27. The audio system of claim 1, wherein the second range of selected frequencies is selected as an intermediate frequency range between frequencies dominated by vowel-like sounds and consonant-like sounds.

28. The audio system of claim 17, wherein the third range of selected frequencies is limited to the voice frequency band.

29. A method for adding a noise signal to an audio signal, comprising:

receiving a first signal;

selecting from the first signal, a volume envelope corresponding to sound intensities of a first range of frequencies;

generating a noise signal, wherein the noise signal corresponds to noise substantially within a second range of frequencies;

generating a modulated noise signal, wherein the modulated noise signal is substantially proportional to the product of the noise signal multiplied by the volume envelope; generating a summation signal, wherein the summation signal is substantially proportional to the sum of a weighted modulated noise signal and a weighted first signal; and filtering the summation signal to generate an output signal comprised of a third range of frequencies.

30. The method of claim 29, further comprising selecting at least one of the first range of frequencies and the second range of frequencies as a function of a user's hearing loss.

31. The method of claim 29, further comprising selecting the first range of selected frequencies from frequencies for which a user's audiometric thresholds exceed a threshold for profound hearing loss or a threshold for severe hearing loss.

32. The method of claim 29, further comprising selecting the second range of frequencies from frequencies for which a user's audiometric thresholds are less than a threshold for profound hearing loss or less than a threshold for severe hearing loss.

33. The method of claim 29, wherein generating the noise signal comprises generating a signal comprised substantially of distributed audio frequencies.

34. The method of claim 29, further comprising selecting the third range of frequencies as a function of a user's hearing loss.

35. The method of claim 29, further comprising filtering the first signal to generate an input signal substantially within a fourth range of frequencies.

36. The method of claim 35, further comprising selecting the fourth range of frequencies as a function of frequencies used for speech.

37. The method of claim 29, further comprising providing an audible or visual warning to the user when time dependent noise exposure criteria has equaled or exceeded a predetermined amount.

38. An audio system, comprising:

a filtered volume determiner configured to receive a first signal, wherein the filtered volume determiner is configured to generate a second signal corresponding to a volume envelope for a first range of selected frequencies of the first signal;

a filtered noise generator configured to generate a third signal corresponding to noise substantially within a second range of selected frequencies;

a signal modulator, coupled to the filtered volume determiner and to the filtered noise generator, wherein the signal modulator is configured to receive from the filtered volume determiner the second signal, and wherein the signal modulator is configured to receive from the filtered noise generator the third signal, and wherein the signal modulator is configured to generate a fourth signal substantially similar to a product of a weighted second signal and a weighted third signal;

a mixer, coupled to the signal modulator, wherein the mixer is configured to receive from the signal modulator the fourth signal, and wherein the mixer is configured to receive a fifth signal substantially similar to the first signal, and wherein the mixer is configured to generate a sixth signal substantially similar to a sum of a weighted fourth signal and a weighted fifth signal;

an input filter coupled to receive an audio signal and generate a filtered input signal substantially within a fourth range of selected frequencies; and a splitter configured to receive the filtered input signal, wherein the splitter generates the first signal and the fifth signal, and wherein the first signal, the fifth signal and the filtered input signal are all substantially similar.

39. The audio system of claim 38, wherein the first range of selected frequencies is selected as a function of a user's hearing loss.

40. The audio system of claim 38, wherein the first range of selected frequencies comprises frequencies for which a user's audiometric thresholds exceed a threshold for profound hearing loss.

41. The audio system of claim 38, wherein the first range of selected frequencies comprises frequencies for which a user's audiometric thresholds exceed a threshold for severe hearing loss.

42. The audio system of claim 38, wherein the first range of selected frequencies is determined by a user.

43. The audio system of claim 38, wherein the second range of selected frequencies is selected as a function of a user's hearing loss.

44. The audio system of claim 38, wherein the second range of selected frequencies comprises frequencies for which a user's audiometric thresholds are less than a threshold for profound hearing loss.

45. The audio system of claim 38, wherein the second range of selected frequencies comprises frequencies for which a user's audiometric thresholds are less than a threshold for severe hearing loss.

46. The audio system of claim 38, wherein the second range of selected frequencies is determined by a user.

47. The audio system of claim 38, wherein the filtered volume determiner comprises a filter coupled to a peak detector, and wherein the filter is configured to receive the first signal and generate a filtered signal, and wherein the peak detector is configured to receive the filtered signal and generate the second signal.

48. The audio system of claim 47, wherein the filter comprises a high-pass filter or a band-pass filter.

49. The audio system of claim 47, wherein the peak detector receives the filtered signal, and wherein the peak detector generates the second signal which is an alpha-filtered absolute value of the filtered signal over a time period.

50. The audio system of claim 38, wherein the filtered noise generator comprises a noise generator coupled to a noise filter, and wherein the noise generator generates a noise signal, and wherein the noise filter is configured to receive the noise signal and generate the third signal.

51. The audio system of claim 50, wherein the noise signal is comprised substantially of distributed audio frequencies.

52. The audio system of claim 50, wherein the noise filter comprises a high-pass filter or a band-pass filter.

53. The audio system of claim 38, wherein an output filter is coupled to receive the sixth signal and generates a seventh signal substantially within a third range of selected frequencies.

54. The audio system of claim 53, wherein the output filter is a low-pass filter.

55. The audio system of claim 53, wherein the third range of selected frequencies is selected as a function of a user's hearing loss.

56. The audio system of claim 53, wherein the third range of selected frequencies comprises frequencies for which a user's audiometric thresholds are less than a threshold for profound hearing loss.

57. The audio system of claim 53, wherein the third range of selected frequencies comprises frequencies for which a user's audiometric thresholds are less than a threshold for severe hearing loss.

58. The audio system of claim 53, wherein the third range of selected frequencies is determined by a user.

59. The audio system of claim 38, wherein the input filter is a low-pass filter.

60. The audio system of claim 38, wherein the fourth range of selected frequencies is selected as a function of frequencies used for speech.

61. The audio system of claim 38, wherein an audible or visual warning is provided to the user of the system indicating that time dependent noise exposure criteria has equaled or exceeded a predetermined amount.

62. The audio system of claim 38, wherein the first range of selected frequencies is dominated by consonant sound components.

63. The audio system of claim 38, wherein the second range of selected frequencies is selected as an intermediate frequency range between frequencies dominated by vowel-like sounds and consonant-like sounds.

64. The audio system of claim 55, wherein the third range of selected frequencies is limited to the voice frequency band.

* * * * *